US010435229B2

(12) United States Patent
Bechyne

(10) Patent No.: US 10,435,229 B2
(45) Date of Patent: Oct. 8, 2019

(54) SLIP-RESISTANT DISPENSING CONTAINER FOR STACKED MOIST WIPES

(71) Applicant: Kimberly-Clark Worldwide, Inc., Neenah, WI (US)

(72) Inventor: Christopher M. Bechyne, Menasha, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 13/777,728

(22) Filed: Feb. 26, 2013

(65) Prior Publication Data

US 2014/0174963 A1 Jun. 26, 2014

Related U.S. Application Data

(63) Continuation-in-part of application No. 13/721,572, filed on Dec. 20, 2012, now Pat. No. 9,125,532, and
(Continued)

(51) Int. Cl.
*A47K 10/42* (2006.01)
*B65D 85/00* (2006.01)
(Continued)

(52) U.S. Cl.
CPC ..... *B65D 85/00* (2013.01); *A47K 10/421* (2013.01); *A47K 10/20* (2013.01); *A47K 2010/3266* (2013.01)

(58) Field of Classification Search
CPC ..... B65D 25/005; B65D 43/0202; B65D 43/0214; B65D 83/0805; A47K 10/16;
(Continued)

(56) References Cited

U.S. PATENT DOCUMENTS 685,900 A 11/1901 Anderson
715,033 A 12/1902 Doolittle
(Continued)

FOREIGN PATENT DOCUMENTS

CN 2803946 Y 8/2006
CN 2920832 Y 7/2007
(Continued)

OTHER PUBLICATIONS

JP_2003137367_translation.pdf.*
(Continued)

*Primary Examiner* — Allan D Stevens
(74) *Attorney, Agent, or Firm* — Kimberly-Clark Worldwide, Inc.

(57) ABSTRACT

A wipes container adapted to be set on a flat surface includes a dispenser housing defining a top and bottom walls, first and second side walls, and first and second end walls. The top wall includes a dispensing orifice. A plurality of wipes is disposed within an interior space. The first end wall has a first slip-resistant periphery and the second end wall has a second slip-resistant periphery. Each slip-resistant periphery includes thermoplastic elastomer material. The thermoplastic elastomer material is disposed along each periphery such that thermoplastic elastomer material contacts an underlying flat surface whether the container is position on its bottom, on a side, or on an end.

16 Claims, 29 Drawing Sheets

Related U.S. Application Data a continuation-in-part of application No. 13/721,633, filed on Dec. 20, 2012, now Pat. No. 9,889,963.

(51) Int. Cl.
*A47K 10/32* (2006.01)
*A47K 10/20* (2006.01)

(58) Field of Classification Search
CPC ..... A47K 10/18; A47K 10/20; A47K 10/24; A47K 10/32; A47K 10/42; A47K 10/421; A47K 10/422; A47K 10/423; A47K 10/425; A47K 10/426; A47K 10/427; A47K 10/44; A47K 2010/3266; A47K 2010/428
USPC ..... 220/796, 916, 229
See application file for complete search history.

(56) References Cited

U.S. PATENT DOCUMENTS

| | | | | |
|---|---|---|---|---|
| 995,720 | A | 6/1911 | Reiss | |
| 1,293,291 | A | 2/1919 | Albig | |
| 2,585,602 | A | 2/1952 | Turner | |
| 3,141,569 | A | 7/1964 | Hanson | |
| 3,221,873 | A | 12/1965 | Bowes et al. | |
| 3,319,782 | A | 5/1967 | Bowes | |
| 3,425,595 | A | 2/1969 | Shapira | |
| 4,863,064 | A * | 9/1989 | Dailey, III | 221/48 |
| 4,865,221 | A | 9/1989 | Jackson et al. | |
| 4,921,103 | A * | 5/1990 | Cohen | 206/523 |
| 5,040,680 | A * | 8/1991 | Wilson et al. | 206/459.5 |
| 5,083,671 | A * | 1/1992 | Hayes | 215/245 |
| 5,163,558 | A | 11/1992 | Palumbo et al. | |
| 5,197,658 | A * | 3/1993 | Sprunger | 229/93 |
| 5,409,181 | A | 4/1995 | Patrick | |
| 5,531,325 | A | 7/1996 | Deflander et al. | |
| 5,746,369 | A | 5/1998 | McDermott | |
| 5,797,542 | A * | 8/1998 | O'Connor | 229/109 |
| 6,186,082 | B1 | 2/2001 | Drobek | |
| 6,213,300 | B1 | 4/2001 | Flaig et al. | |
| 6,296,143 | B1 | 10/2001 | Ghabriel | |
| 6,349,525 | B1 | 2/2002 | Veith | |
| 6,349,849 | B1 | 2/2002 | Pehr | |
| 6,481,589 | B2 * | 11/2002 | Blomdahl et al. | 215/303 |
| 6,523,690 | B1 * | 2/2003 | Buck et al. | 206/494 |
| 6,604,628 | B1 * | 8/2003 | Tanaka et al. | 206/209 |
| 6,672,474 | B2 | 1/2004 | May et al. | |
| 6,702,109 | B1 * | 3/2004 | Tabuchi | 206/233 |
| 6,766,919 | B2 | 7/2004 | Huang et al. | |
| 6,971,542 | B2 * | 12/2005 | Vogel et al. | 221/45 |
| D513,585 | S | 1/2006 | Biesecker et al. | |
| 7,028,840 | B2 * | 4/2006 | Huang et al. | 206/494 |
| 7,055,686 | B2 * | 6/2006 | De-Vries | 206/233 |
| D533,781 | S * | 12/2006 | Freisem et al. | D9/453 |
| 7,172,093 | B2 * | 2/2007 | Bando | 221/63 |
| 7,275,658 | B2 | 10/2007 | Decker et al. | |
| 7,510,095 | B2 * | 3/2009 | Comeau et al. | 215/321 |
| 7,621,401 | B2 | 11/2009 | Alegre | |
| 7,621,420 | B2 * | 11/2009 | Bandoh et al. | 220/326 |
| 7,661,553 | B2 | 2/2010 | Zeiron | |
| 7,794,382 | B2 * | 9/2010 | Cheich | 493/464 |
| 7,992,744 | B2 | 8/2011 | Szymanski et al. | |
| 8,016,155 | B2 | 9/2011 | Decker et al. | |
| 8,397,944 | B1 | 3/2013 | Landes | |
| 2002/0179625 | A1 * | 12/2002 | Huang et al. | 221/63 |
| 2003/0005617 | A1 | 1/2003 | Holverson, Jr. | |
| 2003/0006253 | A1 | 1/2003 | Yelton et al. | |
| 2004/0118862 | A1 | 6/2004 | Amundson | |
| 2004/0251292 | A1 | 12/2004 | Grebonval et al. | |
| 2005/0133387 | A1 * | 6/2005 | Cohen et al. | 206/233 |
| 2005/0205594 | A1 | 9/2005 | Evans et al. | |
| 2005/0211716 | A1 | 9/2005 | Decker et al. | |
| 2005/0242165 | A1 | 11/2005 | Cargile, Jr. | |
| 2005/0258062 | A1 | 11/2005 | Bando | |
| 2006/0131370 | A1 | 6/2006 | Bates | |
| 2006/0151518 | A1 * | 7/2006 | Sarbo et al. | 221/63 |
| 2006/0175222 | A1 * | 8/2006 | Holland et al. | 206/494 |
| 2006/0249524 | A1 | 11/2006 | Headrick | |
| 2007/0131703 | A1 | 6/2007 | Szymonski et al. | |
| 2007/0246390 | A1 | 10/2007 | Alexander | |
| 2007/0284386 | A1 | 12/2007 | Shoemaker | |
| 2008/0067185 | A1 | 3/2008 | Schlaupitz et al. | |
| 2008/0073312 | A1 * | 3/2008 | Babcock et al. | 215/305 |
| 2008/0142536 | A1 * | 6/2008 | Cohen et al. | 221/48 |
| 2008/0272016 | A1 | 11/2008 | Anderson et al. | |
| 2009/0050504 | A1 * | 2/2009 | Stechschulte et al. | 206/459.5 |
| 2009/0194553 | A1 | 8/2009 | Hoefing et al. | |
| 2009/0308777 | A1 * | 12/2009 | Banik et al. | 206/494 |
| 2009/0321299 | A1 * | 12/2009 | Gehring | 206/581 |
| 2010/0122985 | A1 * | 5/2010 | Peters et al. | 220/262 |
| 2011/0011767 | A1 * | 1/2011 | Gehring et al. | 206/581 |
| 2011/0152812 | A1 | 6/2011 | Hird et al. | |
| 2011/0155609 | A1 * | 6/2011 | Mueller et al. | 206/494 |
| 2011/0240514 | A1 * | 10/2011 | Bandoh et al. | 206/555 |
| 2011/0309099 | A1 * | 12/2011 | Bandoh et al. | 220/849 |
| 2012/0084908 | A1 * | 4/2012 | Dunn et al. | 4/483 |
| 2012/0160864 | A1 | 6/2012 | Shoaf et al. | |
| 2012/0175280 | A1 | 7/2012 | Bando et al. | |
| 2012/0251748 | A1 * | 10/2012 | Ashmead et al. | 428/34.7 |
| 2012/0283084 | A1 | 11/2012 | Cheich et al. | |
| 2012/0325716 | A1 | 12/2012 | Evenson et al. | |

FOREIGN PATENT DOCUMENTS

| | | | | |
|---|---|---|---|---|
| CN | 201280088 | Y | 7/2009 | |
| EP | 1035026 | A1 | 9/2000 | |
| EP | 1717162 | A1 * | 11/2006 | A47K 10/42 |
| FR | 2442776 | A1 | 6/1980 | |
| GB | 1281920 | A | 7/1972 | |
| GB | 2284801 | A | 6/1995 | |
| JP | 09-002547 | A | 1/1997 | |
| JP | 09-002548 | A | 1/1997 | |
| JP | 2002-051932 | A | 2/2002 | |
| JP | 2002-053126 | A | 2/2002 | |
| JP | 2003-137367 | A | 5/2003 | |
| JP | 2008-100749 | A | 5/2008 | |
| JP | 2008-272291 | A | 11/2008 | |
| JP | 2008-307779 | A | 12/2008 | |
| JP | 2012-201391 | A | 10/2012 | |
| KR | 20-1996-0003619 | Y1 | 4/1996 | |
| KR | 10-2002-0093207 | A | 12/2002 | |
| KR | 20-0337066 | Y1 | 12/2003 | |
| KR | 10-2010-0025888 | A | 3/2010 | |
| KR | 10-2011-0008812 | A | 1/2011 | |
| TW | M367906 | U | 11/2009 | |
| WO | WO 1993/017933 | A1 | 9/1993 | |
| WO | WO 2000/027268 | A1 | 5/2000 | |
| WO | WO 2003/017237 | A1 | 2/2003 | |

OTHER PUBLICATIONS

Co-pending U.S. Appl. No. 13/330,871, filed Dec. 20, 2012, by Hill et al. for "Wipes Dispenser with Angled Dispensing."
Co-pending U.S. Appl. No. 13/721,633, filed Dec. 20, 2012, by Bechyne for "Refillable Dispensing Container for Stacked Moist Wipes."
Co-pending U.S. Appl. No. 13/721,572, filed Dec. 20, 2012, by Bechyne for "Storing and Dispensing Container for Wipes."
Silicone Kontextur tissue cover, Dec. 1, 2012, viewed on Internet web page "http://nymag.com/shopping/bestbets/led-lights-new-stuff-2011-12/index1.html", 1 page.

* cited by examiner

SLIP-RESISTANT DISPENSING CONTAINER FOR STACKED MOIST WIPES

This application is a continuation-in-part of prior application Ser. No. 13/721,633 and of prior application Ser. No. 13/721,572, both filed Dec. 20, 2012, the entireties of each of which are incorporated herein by reference.

BACKGROUND OF THE INVENTION

There are a variety of storing and dispensing containers in the market, particularly those for storing and dispensing wipe type products. Wipe-type products or wipes have been made from a variety of materials which can be dry or wet when used. Wet wipes can be moistened with a variety of suitable wiping solutions. Typically, wet wipes have been stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes each folded wet wipe is interfolded with the wet wipes immediately above and below it in the stack of wipes. In an alternative configuration, the wet wipes have been placed in a container in the form of a continuous web of material that includes perforations adapted to allow for separation of individual wet wipes from the web upon the application of a pulling force. Such wet wipes have been used for baby wipes, hand wipes, personal care wipes, household cleaning wipes, industrial wipes and the like.

Conventional packages of wipes have typically been designed to be positioned on a flat surface such as a countertop, table or the like. Such conventional packages have often included a plastic container, tub or package which provides a sealed environment for the wet wipes to ensure that they do not become dirty or overly dry. Some of the conventional packages have also been configured to provide "one-at-a-time" dispensing of each wet wipe which can be accomplished using a single hand after the package has been opened. Such single-handed, one-at-a-time dispensing is particularly desirable because the other hand of the user or care giver is typically required to be simultaneously used for other functions. For example, when changing a diaper product on an infant, the care giver typically uses one hand to hold and maintain the infant in a desired position while the other hand is used to dispense a baby wipe to clean the infant.

"Pop-up" configurations of wet wipe dispensers can advantageously help provide the aforementioned single-handed, "one-at-a-time" dispensing. In "pop-up" configurations, when a wipe is removed from the dispenser, the wipe pulls along the leading end of the succeeding wipe in the package, by virtue of the succeeding wipe being in operative contact with the leading wipe such as via interfolding, via adhesive bonding, or via an integral connection along a line of weakness. Preferably, as the leading wipe is pulled out of and away from the package, the trailing end of the leading wipe breaks free from the leading end of the succeeding wipe, and the leading end of the succeeding wipe is left protruding from the package. In this way, the leading end of the succeeding wipe is immediately and automatically positioned for grasping and subsequent withdrawal from the package, and what was previously the succeeding wipe now becomes the leading wipe.

Although moist wipes are most commonly used in conjunction with diapering, moist wipes are increasingly being used for non-diapering purposes, such as cleaning of the face and hands, cleaning up messes, and other uses. Frequently, users wish to have wipes available in locations other than in the nursery, such as in other rooms of the home, or when traveling. Many conventional wipe "tubs" are made of hard plastic materials that have a relatively low coefficient of friction relative to the surfaces upon which the tubs are often set. Conventional wipe containers do not optimally resist slipping and sliding on tables, counters, store shelves, closet shelves, and other flat surfaces.

SUMMARY OF THE INVENTION

In one embodiment, the present invention pertains to a wipes container adapted to be set on a flat surface. The container includes a dispenser housing defining a top wall spaced apart from and generally parallel to a bottom wall, a first side wall spaced apart from and generally parallel to a second side wall, and a first end wall spaced apart from and generally parallel to a second end wall, and all of the walls collectively define an interior space. The top wall includes a dispensing orifice through which wipes can be extracted from the interior space. The container further includes a plurality of wipes disposed within the interior space, and each wipe is adapted to be extracted from the interior space through the dispensing orifice. The first end wall has a first slip-resistant periphery and the second end wall has a second slip-resistant periphery. Each slip-resistant periphery includes thermoplastic elastomer material. The thermoplastic elastomer material is disposed along each periphery such that (1) thermoplastic elastomer material in the first slip-resistant periphery and thermoplastic elastomer material in the second slip-resistant periphery each contact a flat surface when the bottom wall faces the flat surface; (2) thermoplastic elastomer material in the first slip-resistant periphery and thermoplastic elastomer material in the second slip-resistant periphery each contact a flat surface when either of the first and second side walls faces the flat surface; (3) thermoplastic elastomer material in the first slip-resistant periphery contacts a flat surface when the first end wall faces the flat surface; and (4) thermoplastic elastomer material in the second slip-resistant periphery contacts a flat surface when the second end wall faces the flat surface.

In another embodiment, the present invention pertains to a wipes container adapted to be set on a flat surface. The container includes a dispenser housing defining a top wall spaced apart from and generally parallel to a bottom wall, a first side wall spaced apart from and generally parallel to a second side wall, and a first end wall spaced apart from and generally parallel to a second end wall. The top and bottom walls are generally perpendicular to the side walls and the end wall, and the side walls are generally perpendicular to the end walls, and all of the walls collectively define an interior space. The container has a first end proximate the first end wall and a second end proximate the second end wall. The top wall includes a dispensing orifice through which wipes can be extracted from the interior space. The container further includes a plurality of wipes disposed within the interior space, and each wipe is adapted to be extracted from the interior space through the dispensing orifice. The container further comprises a first thermoplastic elastomer loop that wraps around the first end of the container along the top wall, bottom wall, first side wall, and second side wall. The container further comprises a second thermoplastic elastomer loop that wraps around the second end of the container along the top wall, bottom wall, first side wall, and second side wall.

BRIEF DESCRIPTION OF THE DRAWINGS

The present invention will be more fully understood and further features will become apparent when reference is made to the following detailed description of the invention and the accompanying drawings. The drawings are merely representative and are not intended to limit the scope of the claims. Like parts of the packages depicted in the drawings are referred to by the same reference numerals.

DETAILED DESCRIPTION OF PARTICULAR EMBODIMENTS

Figure 1A:
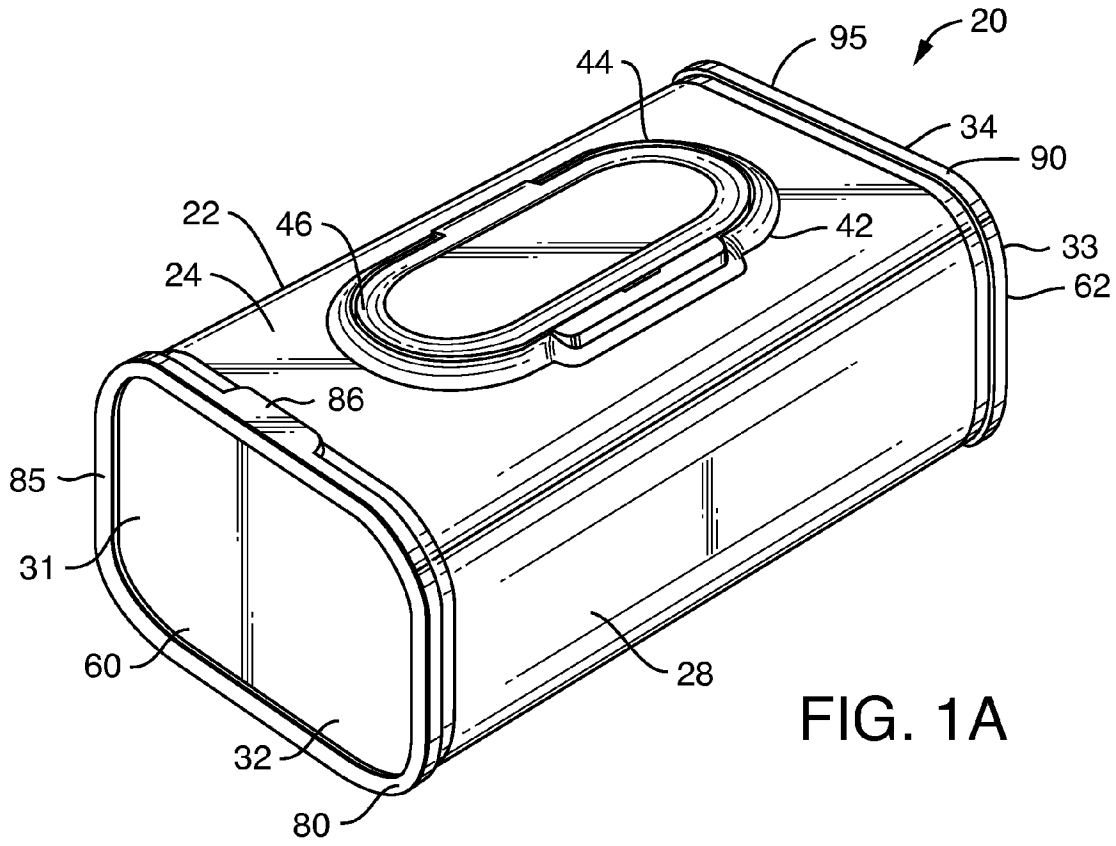
FIG. 1A representatively illustrates a left front perspective view of one embodiment of the present invention, with the flip top in the closed position and with both end wall removable caps attached.

Referring to FIGS. 1-12, the present invention in particular embodiments pertains to a container of moist wipes. The container 20 includes a dispenser housing 22 and a stack 50 of moist wipes 52. The dispenser housing 22 includes a top wall 24 spaced apart from and generally parallel to a bottom wall 26. The dispenser housing 22 further includes a first side wall 28 spaced apart from and generally parallel to a second side wall 30. The dispenser housing 22 further includes a first end wall 32 spaced apart from and generally parallel to a second end wall 34. "Generally parallel" as used herein means disposed between zero and about 30 degrees relative to each other. The walls, 24/26/28/30/32/34 connect together to define an interior space 36. In particular embodiments, the top wall 24, the bottom wall 26, the first side wall 28, the second side wall 30, and at least one layer of the second end wall 34 are integrally molded with each other. When walls 24/26/28/30/32/34 are all connected, the interior space is preferably moisture impervious, so that the moist wipes 52 within the interior space do not dry out. Preferably, the housing 22 is a polyhedron, such as a parallelepiped.

The housing is rigid. As used herein, "rigid" means a level of stiffness commonly associated with materials used to manufacture wet wipes tubs and parts thereof. Numerically, these materials in particular embodiments have a flexural modulus (as measured in accordance with ASTM D790 "Standard Test Method for Flexural Properties of Unreinforced and Reinforced Plastics and Electrical Insulating Materials") of about 100 Newtons per square millimeter or greater, more specifically from about 1100 to about 1550 Newtons per square millimeter.

The first end wall 32 can be moved to provide access to the interior space 36 via a refill orifice 38. For example, in particular embodiments, the first end wall is hingedly connected to one of the top wall 24, bottom wall 26, first side wall 28, or second side wall 30. In other embodiments, the first end wall 32 is completely removable from the remainder of the housing structure.

In the illustrated embodiments, the refill orifice 38 is a housing opening present at or near the ends of the top wall 24, bottom wall 26, first side wall 28, and second side wall 30.

Figure 12A:
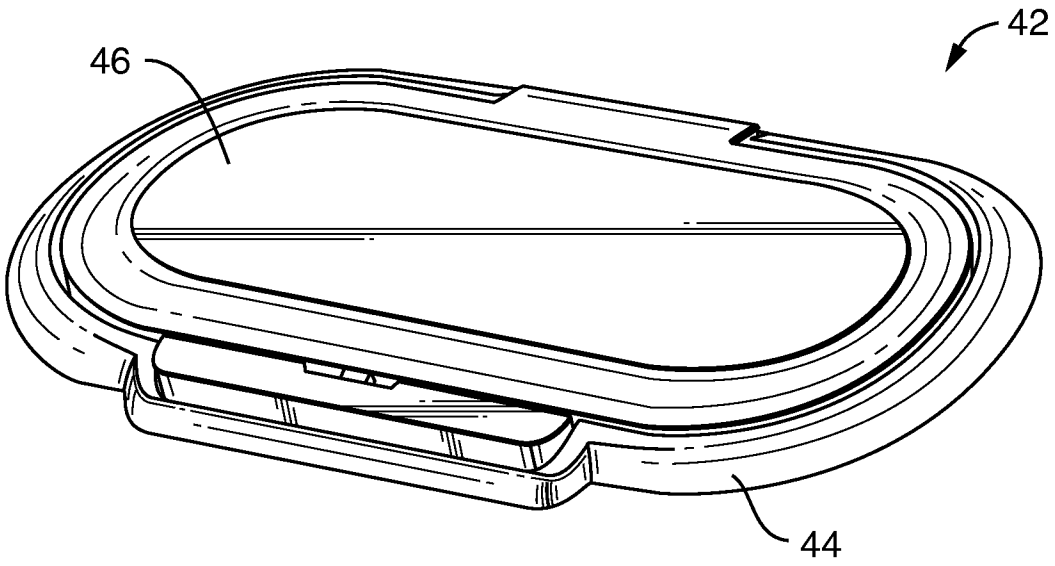
FIG. 12A is a perspective top view of a lid assembly suitable for use in conjunction with particular embodiments of the present invention.
Figure 12B:
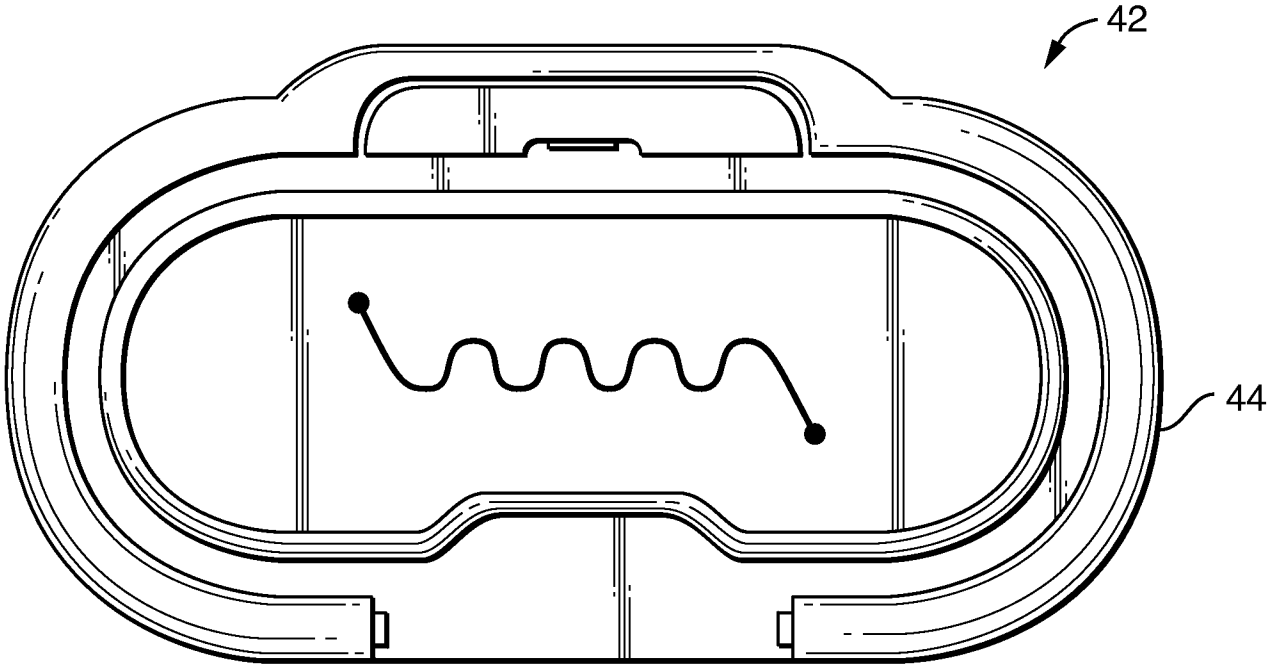
FIG. 12B is a bottom view of the lid assembly of FIG. 12A.
Figure 12C:
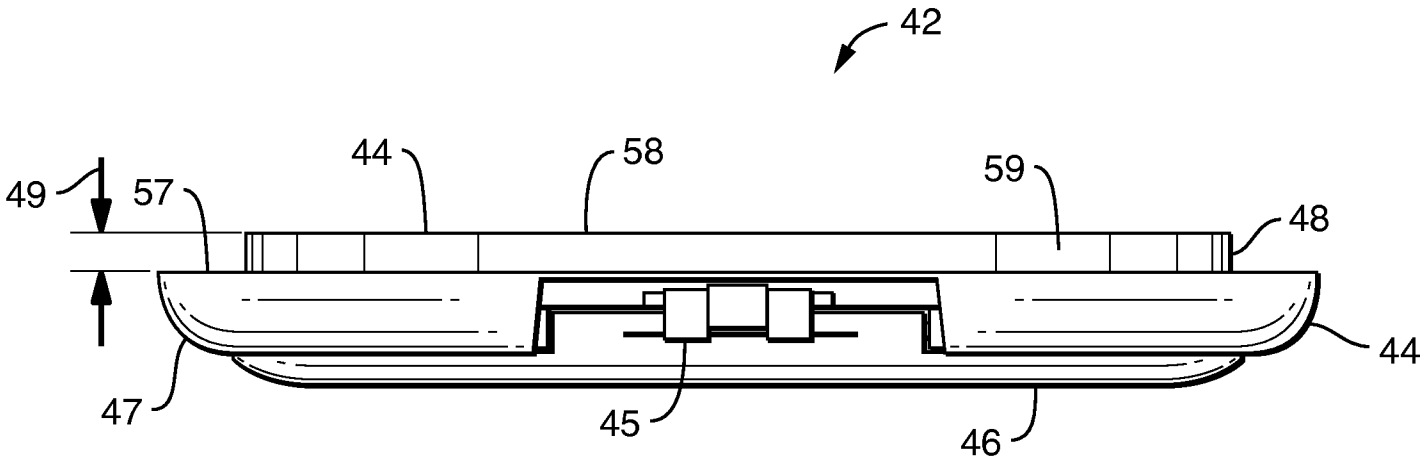
FIG. 12C is a back view of the lid assembly of FIG. 12A.
Figure 12D:
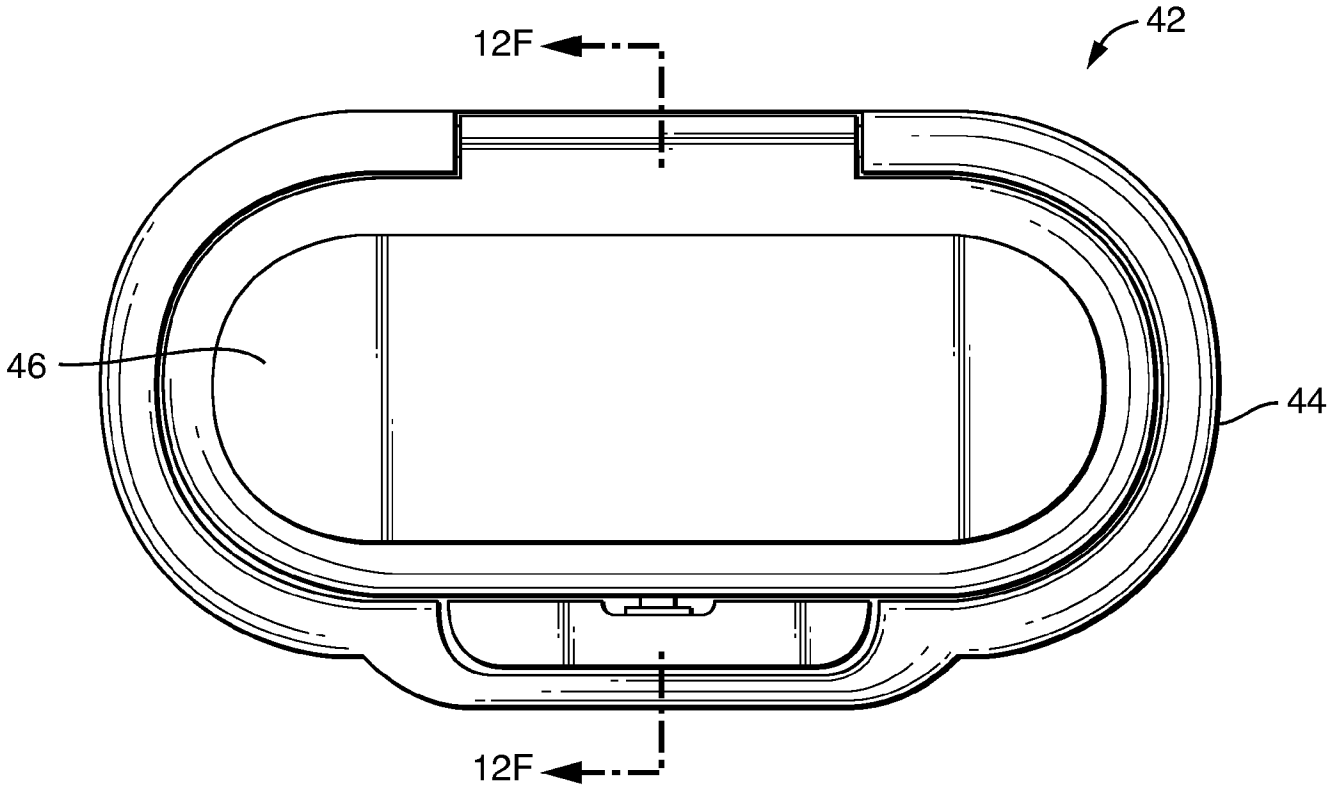
FIG. 12D is a top view of the lid assembly of FIG. 12A.
Figure 12E:
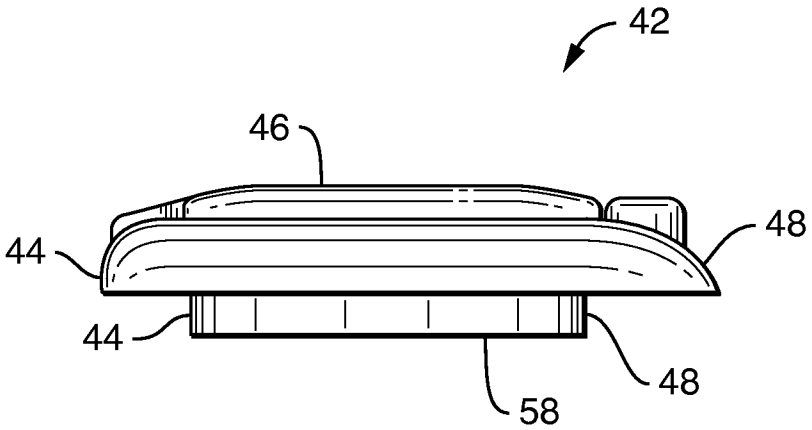
FIG. 12E is an end view of the lid assembly of FIG. 12A.
Figure 12F:
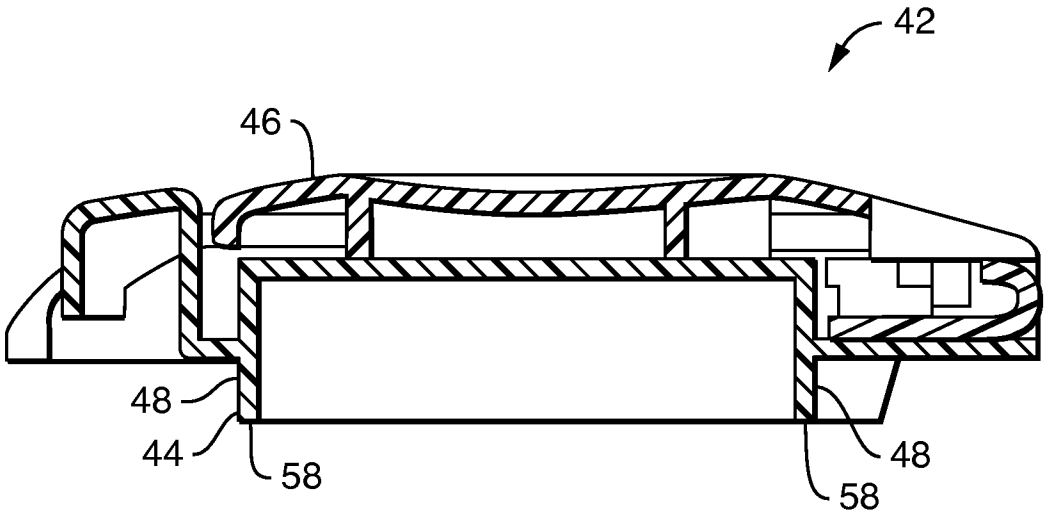
FIG. 12F is a cross-sectional view of the lid assembly of FIG. 12D taken at line 12F.
Figure 13A:
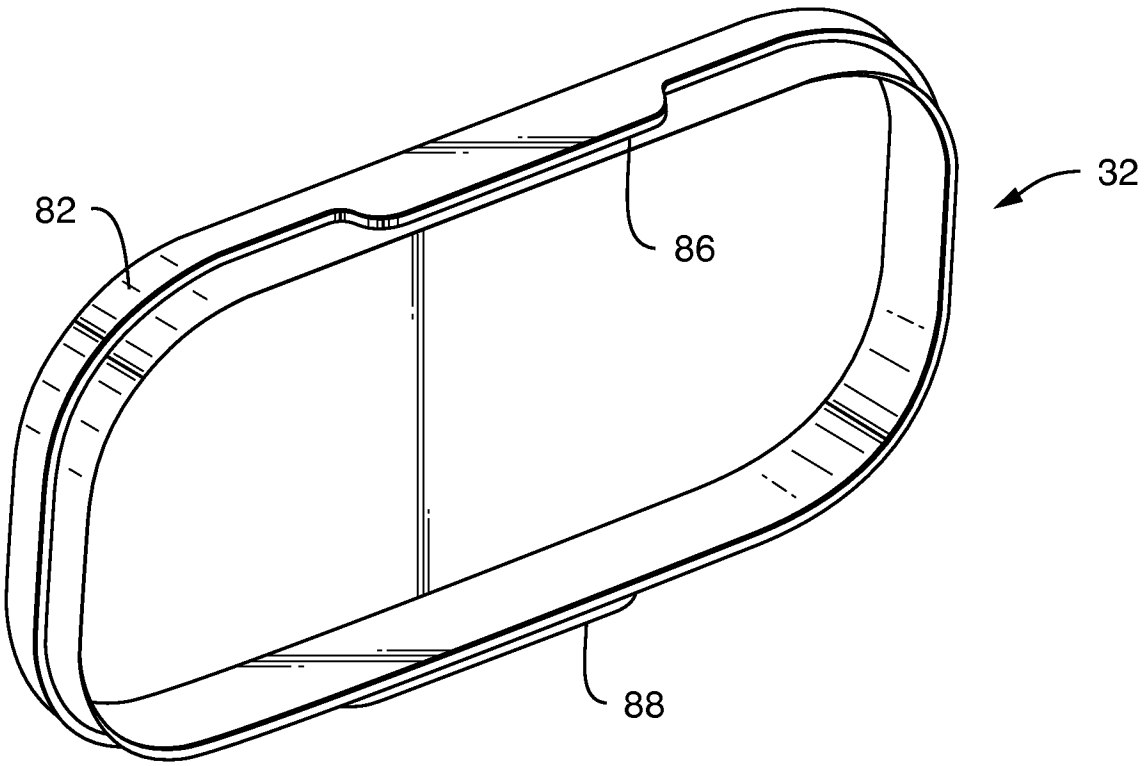
FIG. 13A is an inner perspective view of the first end wall of the embodiment of FIGS. 1-3.
Figure 13B:
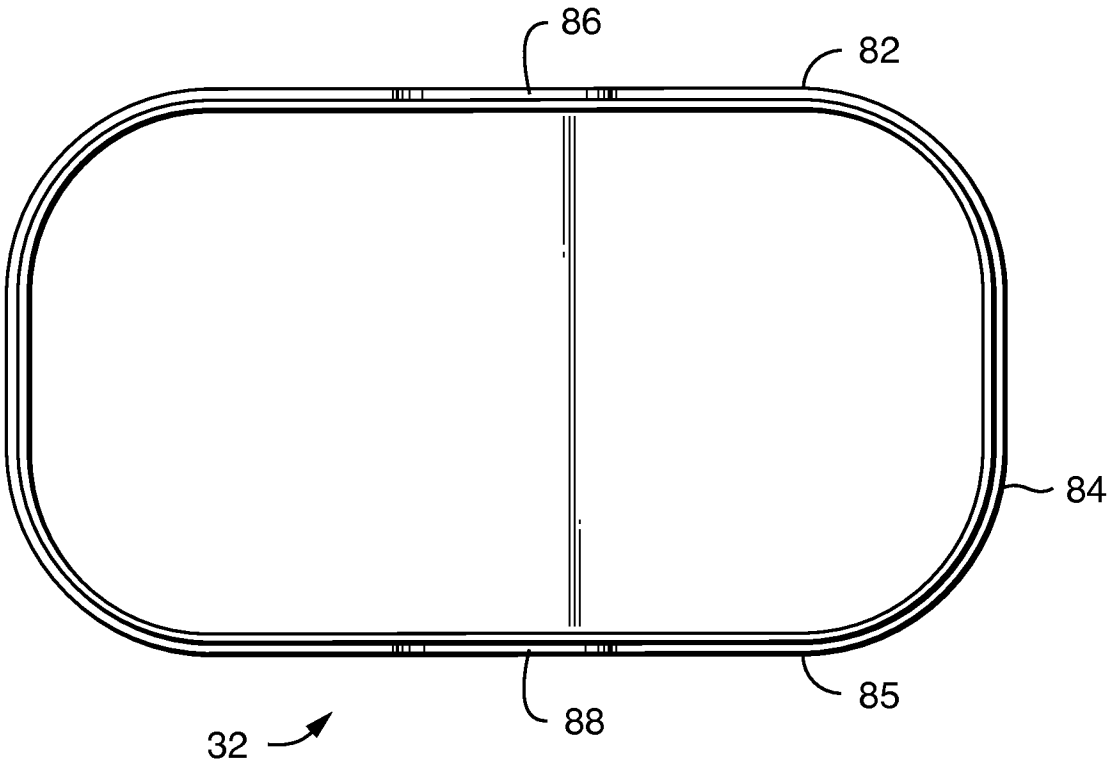
FIG. 13B is an inner plan view of the first end wall of the embodiment of FIGS. 1-3.
Figure 13D:
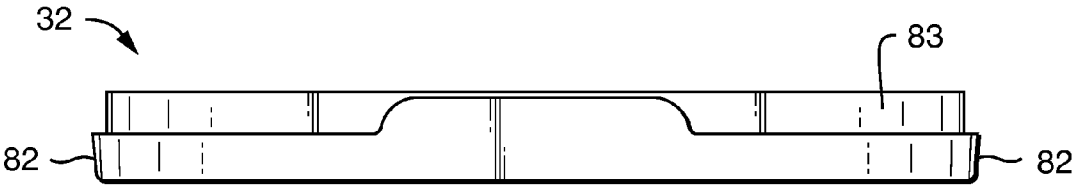
FIG. 13D is a top plan view of the first end wall of the embodiment of FIGS. 1-3.
Figure 13C:
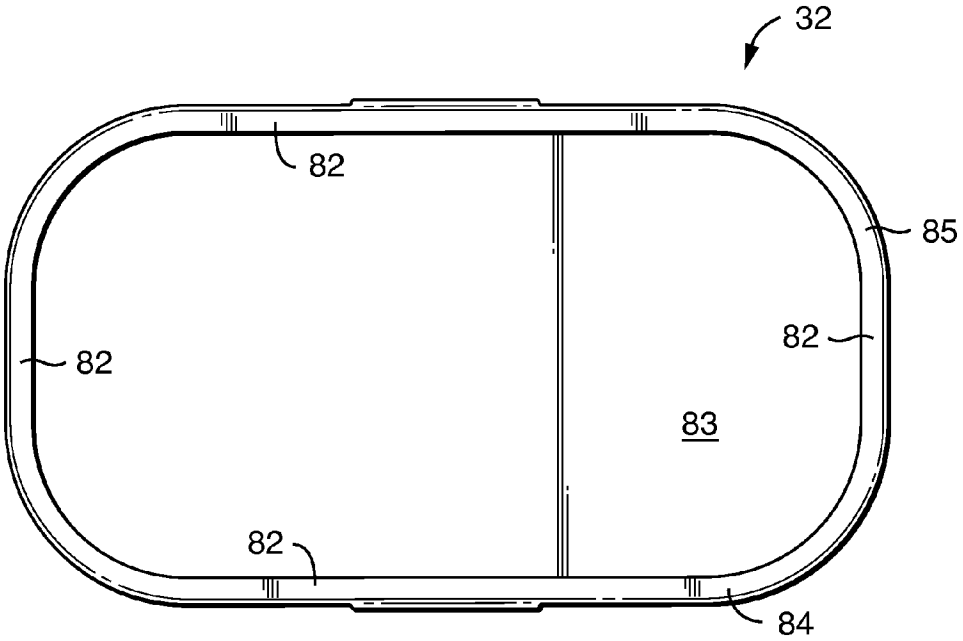
FIG. 13C is an outer plan view of the first end wall of the embodiment of FIGS. 1-3.
Figure 13E:
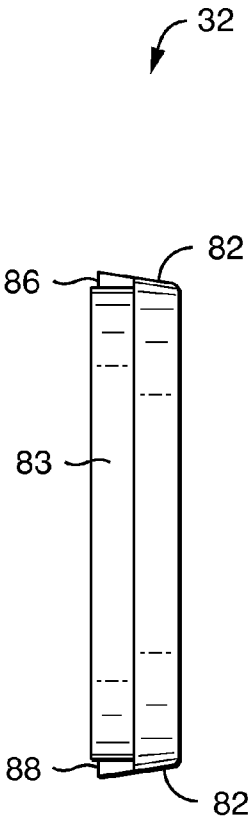
FIG. 13E is a side plan view of the first end wall of the embodiment of FIGS. 1-3.
Figure 14A:
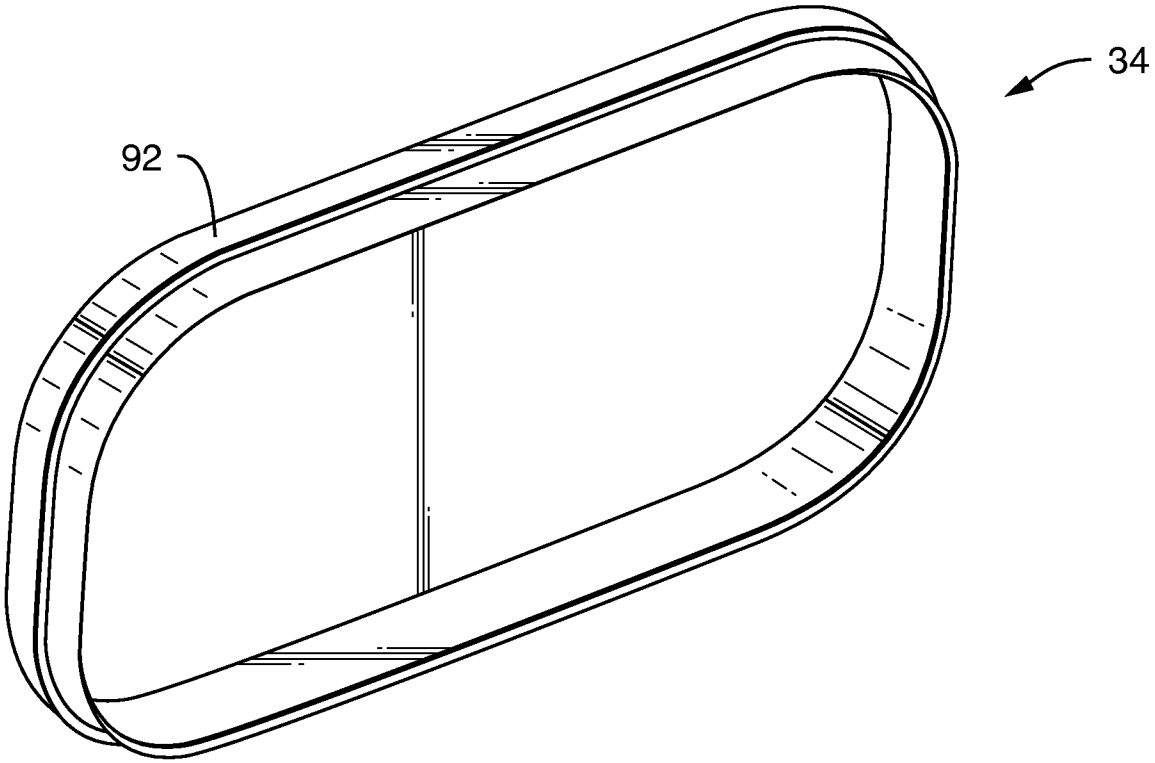
FIG. 14A is an inner perspective view of the second end wall of the embodiment of FIGS. 1-3.
Figure 14B:
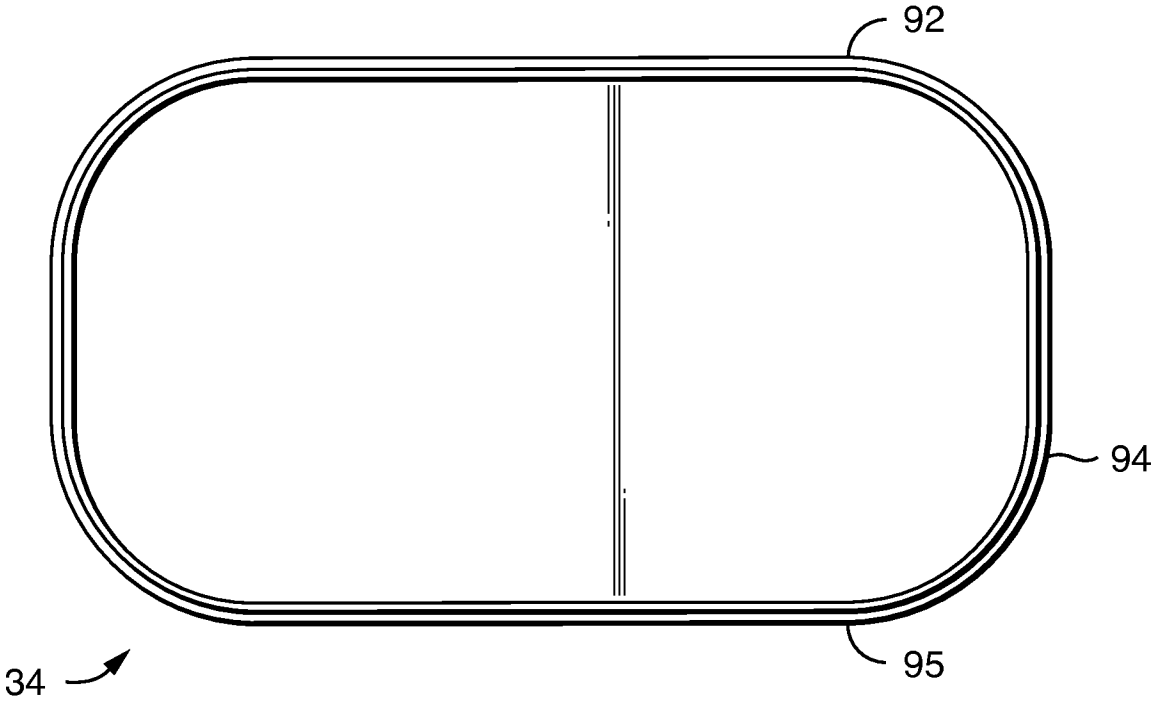
FIG. 14B is an inner plan view of the second end wall of the embodiment of FIGS. 1-3.
Figure 14D:
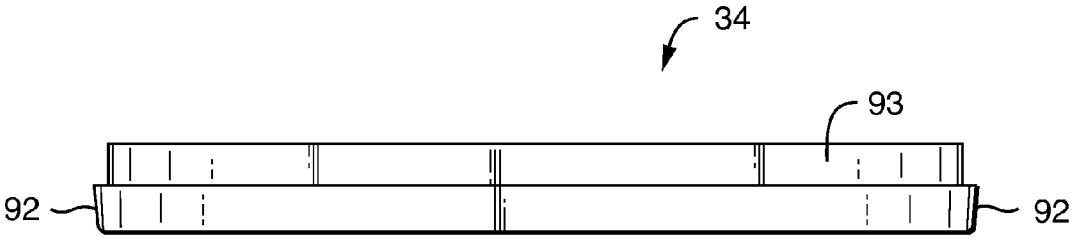
FIG. 14D is a top plan view of the second end wall of the embodiment of FIGS. 1-3.
Figure 14C:
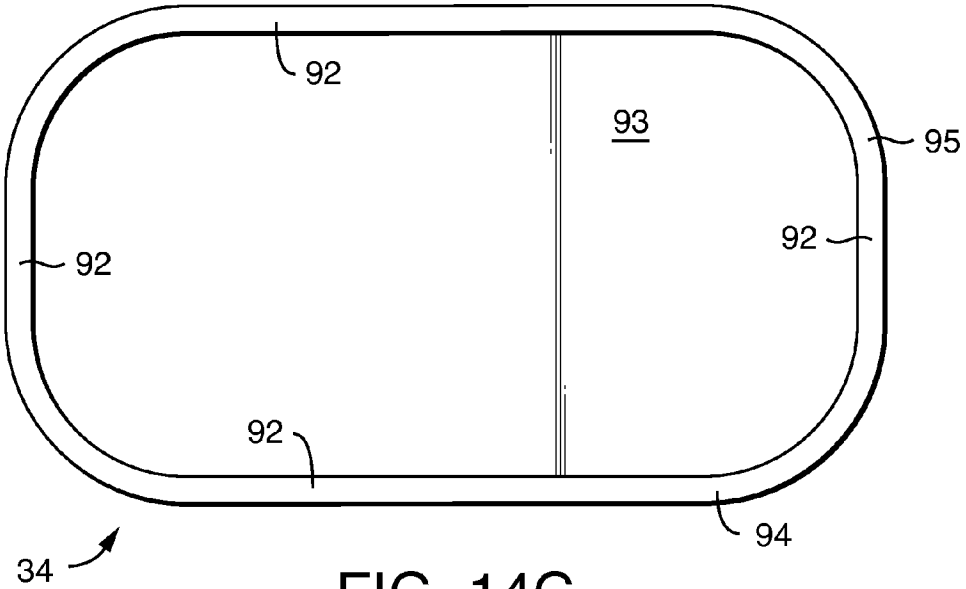
FIG. 14C is an outer plan view of the second end wall of the embodiment of FIGS. 1-3.
Figure 14E:
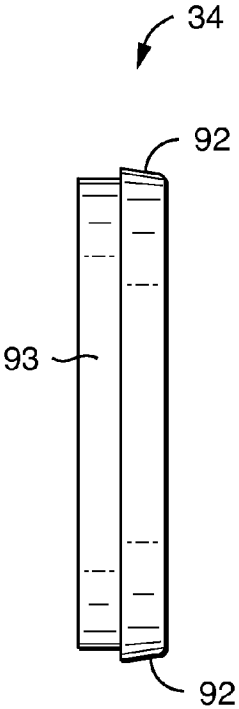
FIG. 14E is a side plan view of the second end wall of the embodiment of FIGS. 1-3.

The top wall 24 includes a dispensing orifice 40 through which individual wipes 52 can be extracted (i.e., dispensed) from the interior space 36. In particular embodiments, the dispensing orifice 40 is covered by a lid assembly 42. The lid assembly 42 can include a ring 44 and a flip top 46, as shown in FIGS. 12A and 12B. The ring 44 can be permanently affixed to the top wall 24, and the flip top 46 can be hingedly connected to the ring at one or more hinges 45.

The top wall 24 has a thickness and defines an inner surface 25. The bottom wall 26 has a thickness and defines an inner surface 27. The top wall 24 is spaced apart from the bottom wall 26 in a height dimension 29. The height dimension is perpendicular to both the plane substantially defined by the top wall and the plane substantially defined by the bottom wall. The interior space 36 has an interior space height 37 that extends in the height dimension 29 from the inner surface 25 of the top wall 24 to the inner surface 27 of the bottom wall 26. "Interior space height" as used herein means the greatest distance that exists between the top wall inner surface 25 and the bottom wall inner surface 27 in the height dimension 29.

In particular embodiments, the moist wipes 52 are stacked upon each other in the height dimension 29 and are disposed within the interior space 36, and each moist wipe 52 is adapted to be extracted by a user from the interior space 36 through the dispensing orifice 40—preferably one at a time. The wipes are desirably configured within the stack 50 to provide "pop-up" dispensing. In such configurations, when a wipe is removed from the dispenser, the wipe pulls along the leading end of the succeeding wipe in the package, by virtue of the succeeding wipe being in operative contact with the leading wipe such as via interfolding, via adhesive bonding, or via an integral connection along a line of weakness. Preferably, as the leading wipe is pulled out of and away from the package, the trailing end of the leading wipe breaks free from the leading end of the succeeding wipe, and the leading end of the succeeding wipe is left protruding from the package. In this way, the leading end of the succeeding wipe is immediately and automatically positioned for grasping and subsequent withdrawal from the package, and what was previously the succeeding wipe now becomes a leading wipe. Alternatively, the container 20 may include a stack 50 of wipes 52 in a non-interfolded configuration, for "reach-in" dispensing. For such a non-interfolded wipe, each wipe may be folded onto itself with no portion of another wipe being positioned between or underneath any portion of the folds of the adjacent wipe(s). In particular embodiments, each of the moist wipes 52 in the stack 50 are interfolded with one another, such as via c-folds, z-folds, or other zig zag folds. In other embodiments, the moist wipes 52 in the stack 50 are interconnected via frangible lines of weakness. For example, the wipes can be arranged in the housing as a continuous web of interconnected wipes which are folded in an accordion-like stacked configuration. The individual wipes can be connected together along lines of frangibility, such as lines of perforations, to ensure that the trailing wipe is in position for grasping by the user after the leading wipe is removed. For example, the wipes can be provided by a continuous web of material which has a series of lines of frangibility extending across the width of the web. Each portion of the web of material between successive lines of frangibility constitutes an individual wipe. The lines of frangibility can be provided by means known to those skilled in the art such as perforations, indentations, score lines, or cuts in the web of material.

The container of the present invention can include any suitable number of individual wipes depending upon the desired packaging and end use. For example, the container can be configured to include a stack of wipes of at least about 5 wipes and desirably from about 8 to about 320 individual wipes, and more desirably from about 16 to about 64 wipes. Each wipe is in particular embodiments generally rectangular in shape.

Materials suitable for the wipes employed in conjunction with the present invention are well known to those skilled in the art. For example, the wipes 52 can be made from nonwoven materials such meltblown, coform, air-laid, or bonded-carded web materials, hydroentangled materials, high wet-strength tissue, or the like, and can comprise synthetic or natural fibers or combinations thereof. The wipes of the different aspects of the present invention can contain a liquid which can be any solution which can be absorbed into or entrained within the wipes, thus making them "wet wipes." The liquid contained within the wet wipes can include components which provide the desired wiping properties. For example, the components can include water, emollients, surfactants, preservatives, chelating agents, pH buffers, fragrances, or combinations thereof. The liquid can also contain lotions, ointments, and/or medicaments. The amount of liquid contained within each wet wipe can vary depending upon the type of material being used to provide the wet wipe, the type of liquid being used, the type of container being used to store the stack of wet wipes, and the desired end use of the wet wipe. Generally, each wet wipe can contain from about 150 to about 600 weight percent and desirably from about 200 to about 400 weight percent liquid based on the dry weight of the wipe.

The housing 22 and/or lid assembly 42 can be opaque or, alternatively, can be transparent or translucent to allow a visual inspection of the quantity of wipes remaining in the container. The housing and/or lid assembly can be made of various polymers, copolymers, and mixtures, including, e.g., polyethylene, polypropylene, polyester, and polystyrene.

As noted above, the first end wall 32 can be removed to provide access to the interior space 36. In particular embodiments, the first end wall 32 constitutes a removable cap 60. The removable cap 60 has in particular embodiments no permanent connection to the top wall 24, bottom wall 26, first side wall 28, or second side wall 30. The removable cap 60 and housing 22 preferably are configured to snap together, such as via a tongue-and-groove or rib-and-recess relationship.

In particular embodiments, the second end wall 34 can also be removed to provide access to the interior space 36. In particular embodiments, the second end wall 34 includes a removable cap 62. The removable cap 62 has in particular embodiments no permanent connection to the top wall 24, bottom wall 26, first side wall 28, or second side wall 30. The removable cap 62 and housing 22 preferably are configured to snap together, such as via a tongue-and-groove or rib-and-recess relationship.

Figure 6A:
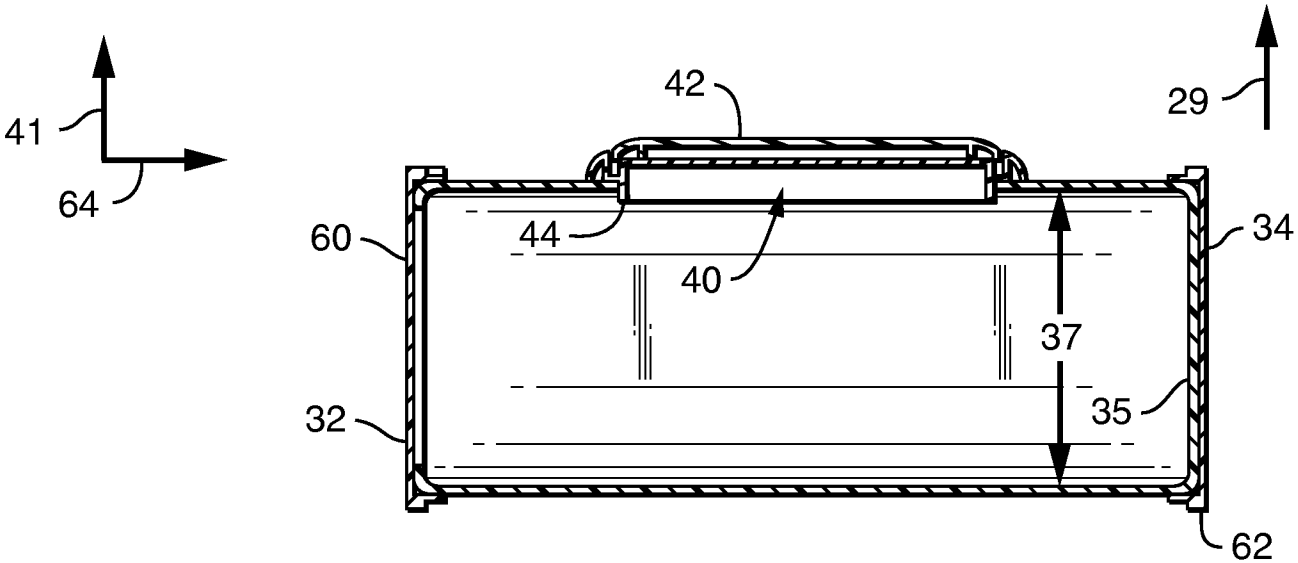
FIG. 6A representatively depicts a cross-sectional view of the embodiment of FIG. 5 taken at line 6-6, but with both end wall removable caps attached.
Figure 7A:
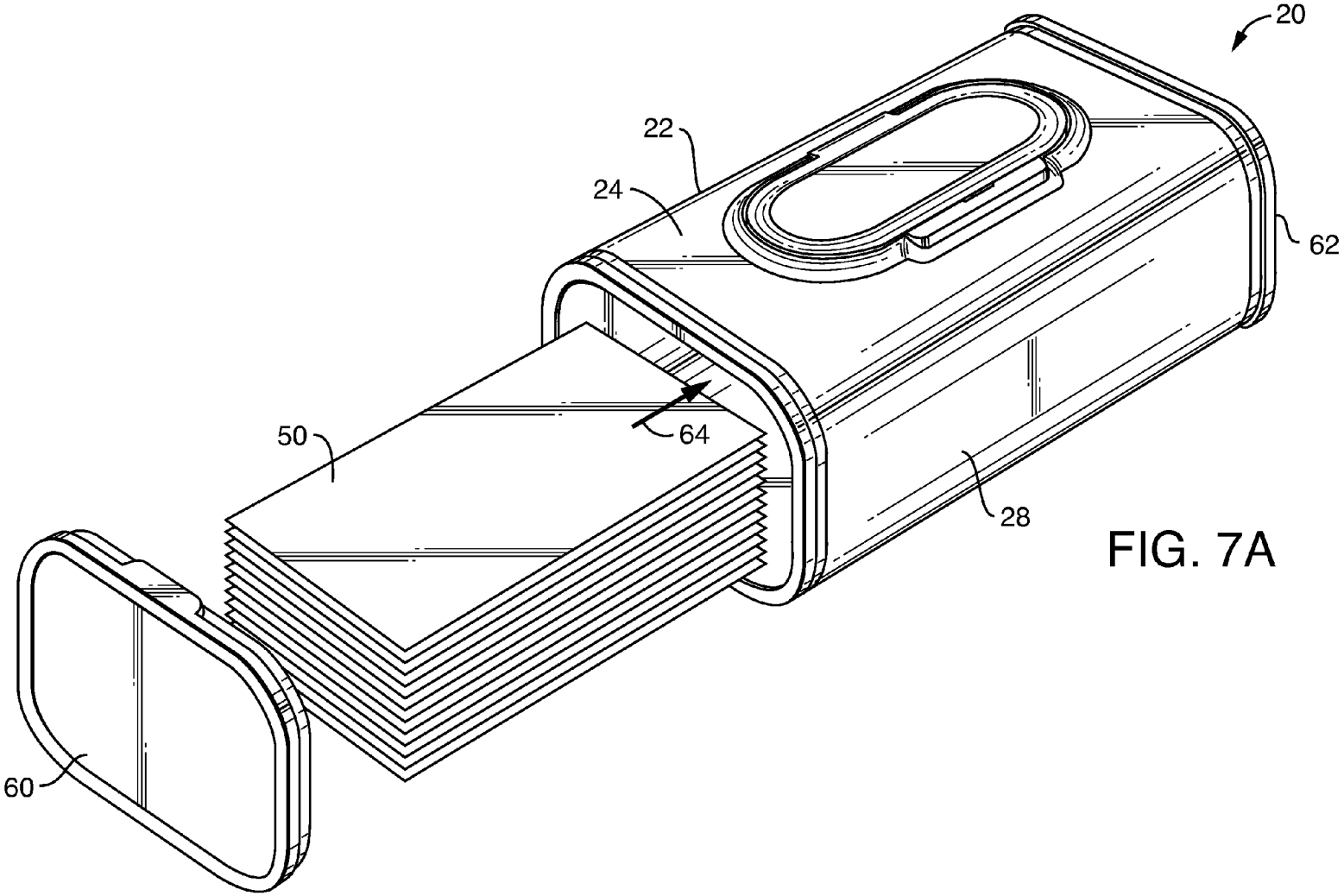
FIG. 7A representatively illustrates the embodiment of FIG. 1A, but with one end wall removable end cap and a stack of moist wipes shown in an exploded view.
Figure 7B:
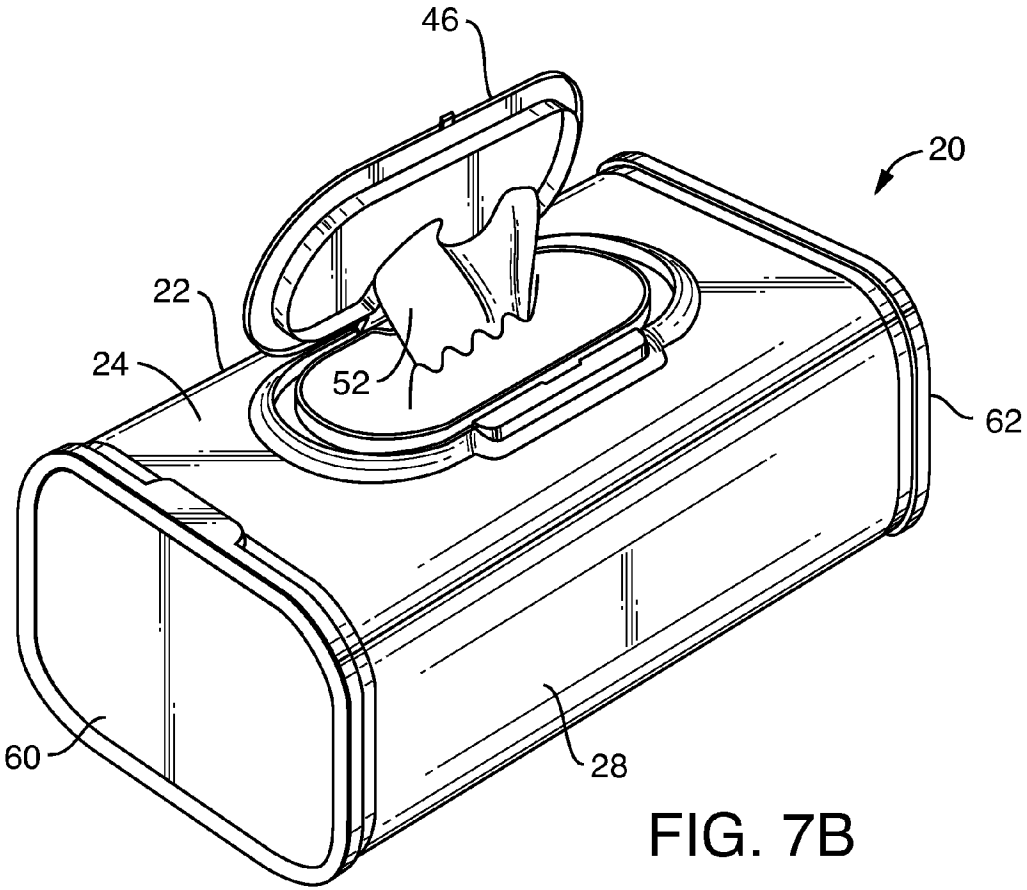
FIG. 7B is the same as FIG. 1B, but with a wipe depicted in a partially dispensed position.

By providing access to the interior space via a removable first end wall 32, a removable second end 34, or both, the dispenser housing 22 can be refilled with a new stack 50 of wipes after the previous stack of wipes has been consumed. As shown in FIG. 7A, the new stack 50 of wipes is inserted into the housing in a refill direction 64. The refill direction 64 is generally perpendicular to a dispensing direction 41, as representatively illustrated in FIGS. 6, 6A, and 8.

In particular embodiments, the second end wall 34 includes a permanent layer 35 integrally formed with the top wall 24, bottom wall 26, first side wall 28, and second side wall 30. In such embodiments, the first end wall 32 can include a first removable cap 60 (preferably having no permanent connection to the top wall 24, bottom wall 26, first side wall 28, or second side wall 30), and the second end wall 34—in addition to having a permanent, integral layer 35 as just described—also includes a second removable cap 62 (preferably having no permanent connection to the top wall 24, bottom wall 26, first side wall 28, or second side wall 30). Preferably, the second removable cap 62 is substantially identical in structure to the first removable cap 60. In this way, the first end wall 32 is in particular embodiments completely removable, thus providing access to the interior space 36, but the second end wall 34 includes a permanent, integral layer to provide improved structural integrity and/or improved moisture retention function to the container 20. At the same time, by in particular embodiments including similar or identical caps 60, 62 on each end of the container, the container is provided with the appearance of structural symmetry when fully assembled, which can provide desirable aesthetics as well improved functionality in certain circumstances. "Substantially identical in structure" as used in this context means that the first and second removable caps are sufficiently structurally similar such that they can be switched and attached to opposite ends of the housing, but can possess minor differences with respect to each other, such as the presence of a finger tab or a molded brand name on one cap but not the other.

As noted earlier, the interior space 36 has an interior space height 37 that extends from the inner surface 25 of the top wall 24 to the inner surface 27 of the bottom wall 26. The stack 50 of wipes 52 defines a stack height 51. It has been discovered that if the stack height 51 is the same as the interior space height 37, two problems can in certain circumstances result. First, if the top 53 of the stack 50 is too firmly pressed against the inner surface 25 of the top wall 24, dispensing of the top wipe or wipes in the stack 50 can be impeded. Second, the lid assembly 42 may in particular aspects of the invention protrude slightly through the dispensing orifice 40 into the interior space 36 (described in more detail below). In such embodiments, if the stack height 51 is the same as the interior space height 37, the stack 50 of wipes 52 will collide with the inwardly protruding portion of the lid assembly 42 when the stack 50 is inserted into the interior space 36 through the refill orifice 38, which can lead to crumpling and clogging of wipes within the container. For these two reasons, it is desirable with certain embodiments of the container 20 to control the stack height 51 of stacks 50 that can be used to refill the container 20.

To meet this need, an arrangement to limit stack height 51 has been invented. The refill orifice 38 has a refill orifice height 39 extending in the height dimension 29. In particular embodiments, the refill orifice height 39 is less than 95%, and more particularly less than 90%, of the interior space height 37. One technique suitable for providing a refill orifice height 39 that is less than the interior space height 37 is by use of an end flange. For example, in one embodiment, representatively illustrated in FIGS. 5 and 8, the refill orifice 38 is partially bordered by at least one end flange 70. The end flange 70 extends from the top wall 24 toward the bottom wall 26 and terminates at an end flange edge 71. The end flange 70 is in particular embodiments integrally formed with the top wall 24.

Figure 5:
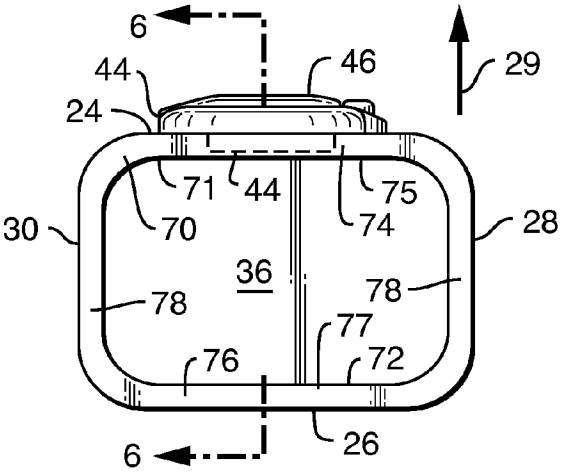
FIG. 5 representatively illustrates an end view of the embodiment of FIG. 10, with the end wall removable cap absent.
Figure 8:
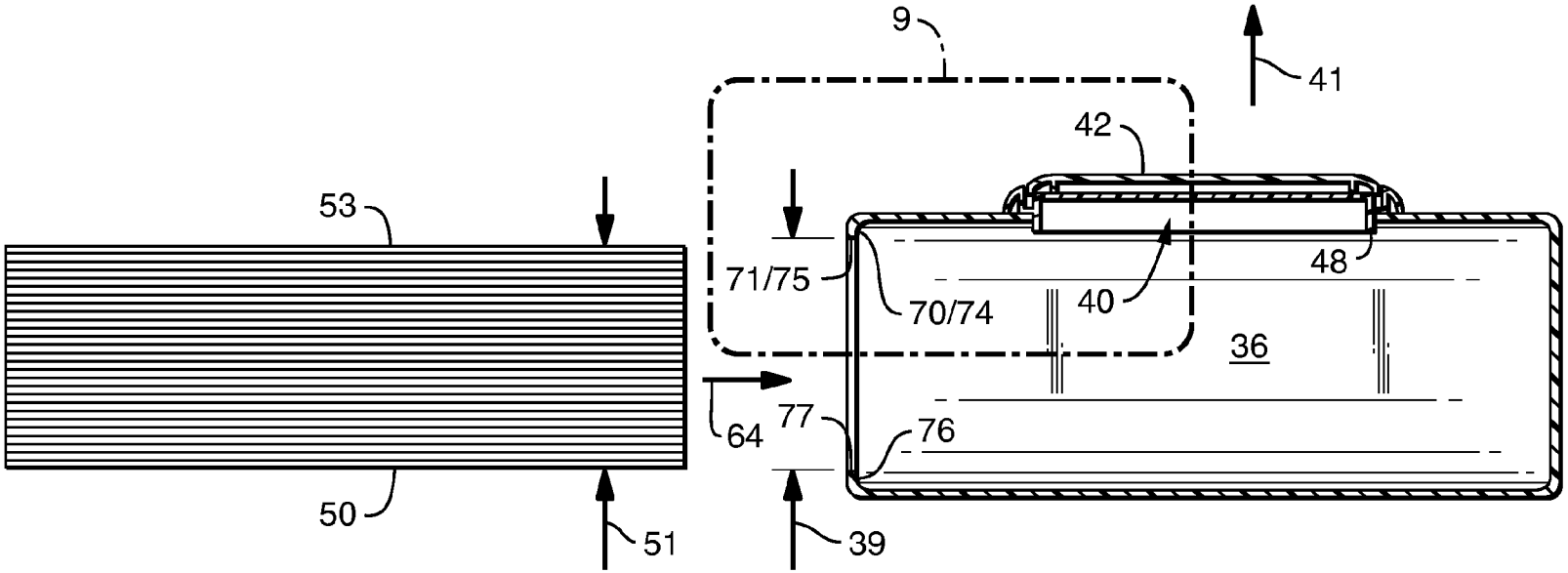
FIG. 8 representatively illustrates the same embodiment and view depicted in FIG. 6, along with a front view of a stack of moist wipes suitable for use in conjunction with particular embodiments of the invention.

Still referring to FIGS. 5 and 8, in particular embodiments, the refill orifice 38 is surrounded by a continuous end flange 72. An upper portion 74 of the continuous end flange 72 extends from the top wall 24 toward the bottom wall 26 and terminates at an upper portion edge 75. Preferably, the upper portion 74 is integrally formed with the top wall 24. Further, a lower portion 76 of the continuous end flange 72 extends from the bottom wall 26 toward the top wall 24 and terminates at a lower portion edge 77. Preferably, the lower portion 76 is integrally formed with the bottom wall 26. The continuous flange also includes side portions 78, 78. In additional to limiting the height 51 of the stack 50 that can be inserted into the housing, a continuous end flange 72 can in particular embodiments provide additional structural integrity to the housing 22.

As noted above, the lid assembly 42 in particular embodiments includes a ring 44 and a flip top 46, and the ring 44 is preferably permanently affixed to the top wall 24. Referring to FIGS. 8-10 and 12A-12F, in particular embodiments, the ring 44 includes an upper portion 47 and a buffering flange 48. The upper portion 47 overlaps and generally extends along the dispensing orifice perimeter 43. The upper portion 47 is the portion of the ring 44 that extends outward from the top wall 24 ("outward" as used herein meaning away from the interior space 36). The buffering flange 48 protrudes from the upper portion 47 into the interior space 36. The top wall 24 has a thickness 23, and the buffering flange has a height 49. The thickness 23 of the top wall 24 as referenced herein means the thickness measured via any suitable means (such as a caliper) measured approximately one centimeter away from the dispensing orifice perimeter 43. The height 49 of the buffering flange 48 as referenced herein means the distance from the underside 57 of the upper portion 47 to the distal end 58 of the buffering flange 48. In particular embodiments, the buffering flange height 49 is greater than the top wall thickness 23. For example, in particular embodiments, the height 49 of the buffering flange 48 is at least 20% greater, more particularly at least 50% greater, and still more particularly at least 100% greater than the thickness 23 of the top wall 24.

In particular embodiments, the buffering flange 48 defines a buffering flange outer perimeter 59. In particular embodiments, the length of the buffering flange outer perimeter 59 is less than the length of the dispensing orifice perimeter 43. Preferably, the length of the buffering flange outer perimeter 59 is only slightly less (e.g., between 0% and 2% less) than the length of the dispensing orifice perimeter 43, such that the buffering flange 48 fits snugly into the dispensing orifice 40.

As noted above, in particular embodiments, the first end wall can be removed to provide access to the interior space via a refill orifice 38, and the refill orifice 38 can be partially bordered by at least one end flange. In particular embodiments, the end flange 70 has an end flange height 73. The end flange height as referenced herein is the distance measured from the top wall inner surface 25 to the end flange edge 71, as representatively illustrated in FIGS. 9 and 10. In particular embodiments, the sum of the end flange height 73 and the top wall thickness 23 is greater than the buffering flange height 49. Similarly, as described above, in particular embodiments the refill orifice 38 is surrounded by a continuous end flange 72. The upper portion 74 of the continuous end flange 72 has a continuous end flange upper portion height, measured from the top wall inner surface 25 to the upper portion edge 75. In particular embodiments, the sum of the continuous end flange upper portion height and the top wall thickness 23 is greater than the buffering flange height 49. In this way, the stack height 51 of the stacks 50 that are used to refill the container 20 can in particular embodiments be controlled so that the stack 50 does not collide with or press against the buffering flange 48 as the refill is inserted or after the refill has been completely inserted into the interior space 36.

Figure 10:
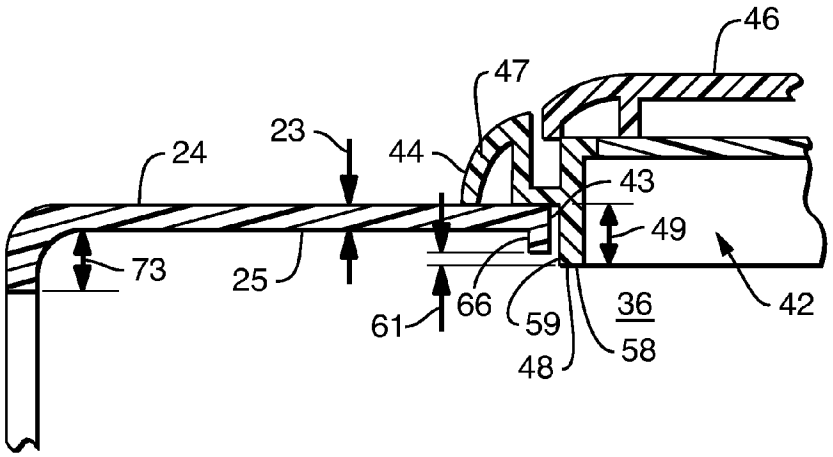
FIG. 10 is a detail view of an alternative embodiment of the portion of FIG. 8 indicated by reference numeral 9.
Figure 9:
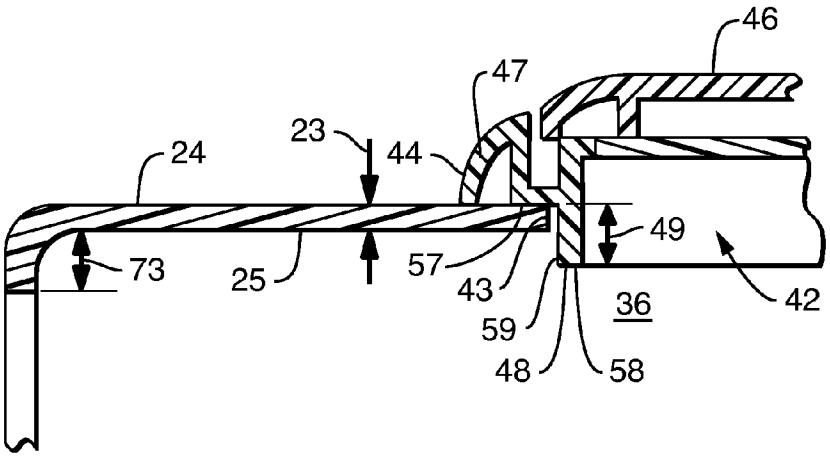
FIG. 9 is a detail view of the portion of FIG. 8 indicated by reference numeral 9.
Figure 11:
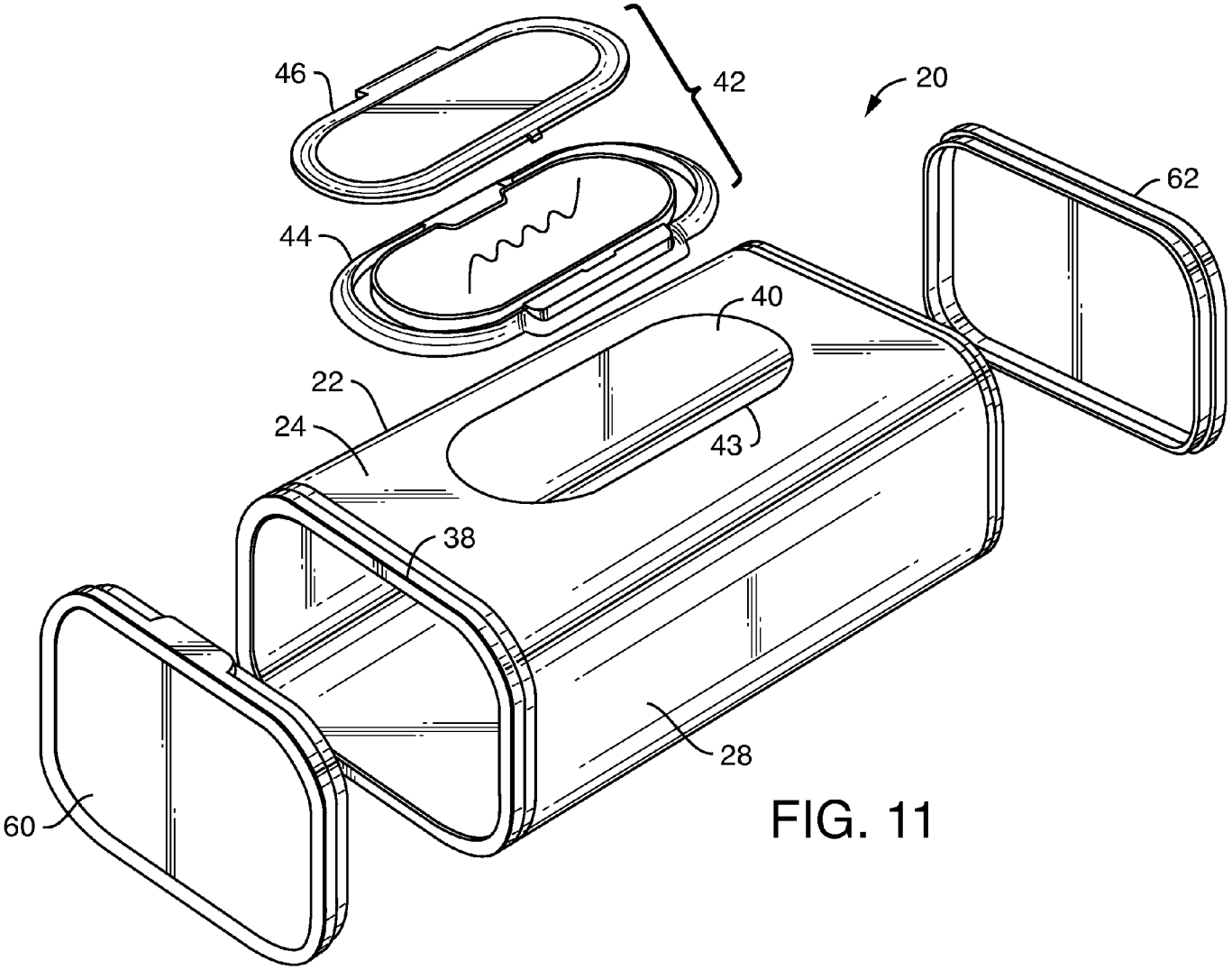
FIG. 11 representatively illustrates the embodiment of FIG. 1A, but with both end wall removable end caps and the lid assembly shown in a exploded view.

In certain embodiments, referring to FIGS. 8-10, the buffering flange 48 protrudes from the flip top upper portion 47 into the interior space 36 past the inner surface 25 of the top wall 24. In particular embodiments, such as that representatively illustrated in FIG. 10, the top wall 24 includes a top wall flange 66 integrally formed with the top wall 24. In particular embodiments, the top wall flange 66 surrounds the dispensing orifice 40 and extends into the interior space 36. For example, in one preferable process for commercially manufacturing the container 20, the dispenser housing 22 is blow-molded, and the dispensing orifice 40 is created by cutting or stamping out a section of material. This cutting or stamping step can create a flange 66 in the top wall 24, and such flange 66 can in particular embodiments be rough or jagged. In particular embodiments, the buffering flange 48 extends into the interior space 36 further than the top wall flange 66 extends into the interior space 36. For example, in particular embodiments, the buffering flange 48 extends past the top wall flange 66 by a distance 61 of at least one millimeter, and more particularly by at least two millimeters. In this way, as a wipe 52 is extracted from the interior space 36 through the dispensing orifice 40, the buffering flange 48 will prevent the wipe from catching or snagging on the top wall flange 66, thus allowing smooth, unhindered passage of the wipe out of the container.

Referring to FIGS. 1, 2, and 13-15, the wipes container 20 desirably is adapted to be set on a flat surface 21. In particular embodiments, the first end wall 32 has a first slip-resistant periphery 80, and the second end wall 34 has a second slip-resistant periphery 90. Each slip-resistant periphery 80, 90 includes thermoplastic elastomer material. "Thermoplastic elastomer material" (TPE) is known in the art. Furthermore, although rubber is not technically considered a thermoplastic elastomer material as those terms are traditionally used in the art, "thermoplastic elastomer material" as used herein includes rubber material.

Figure 15A:
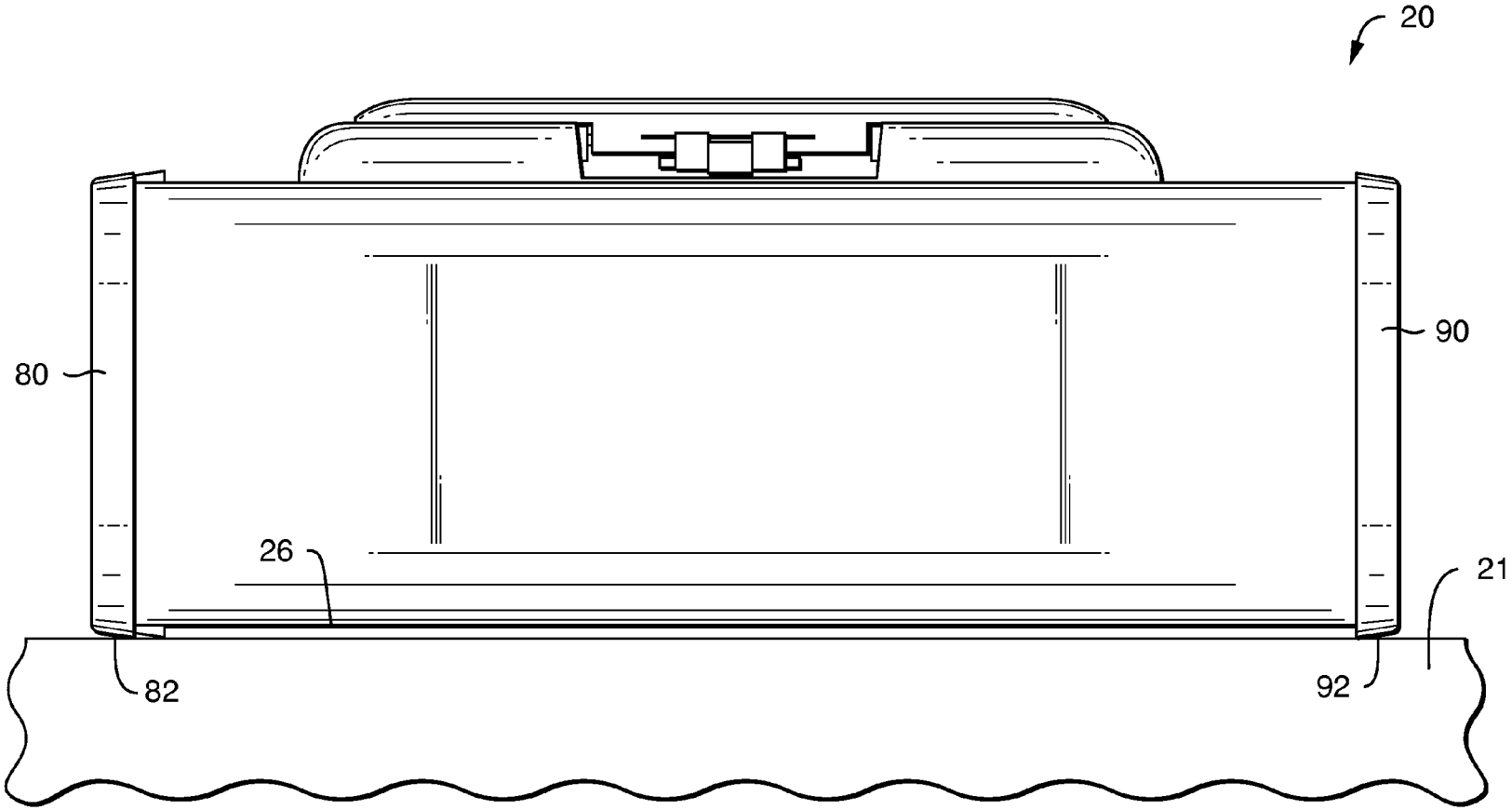
FIG. 15A depicts the embodiment of FIGS. 1-3 positioned on a surface in a first orientation.
Figure 15B:
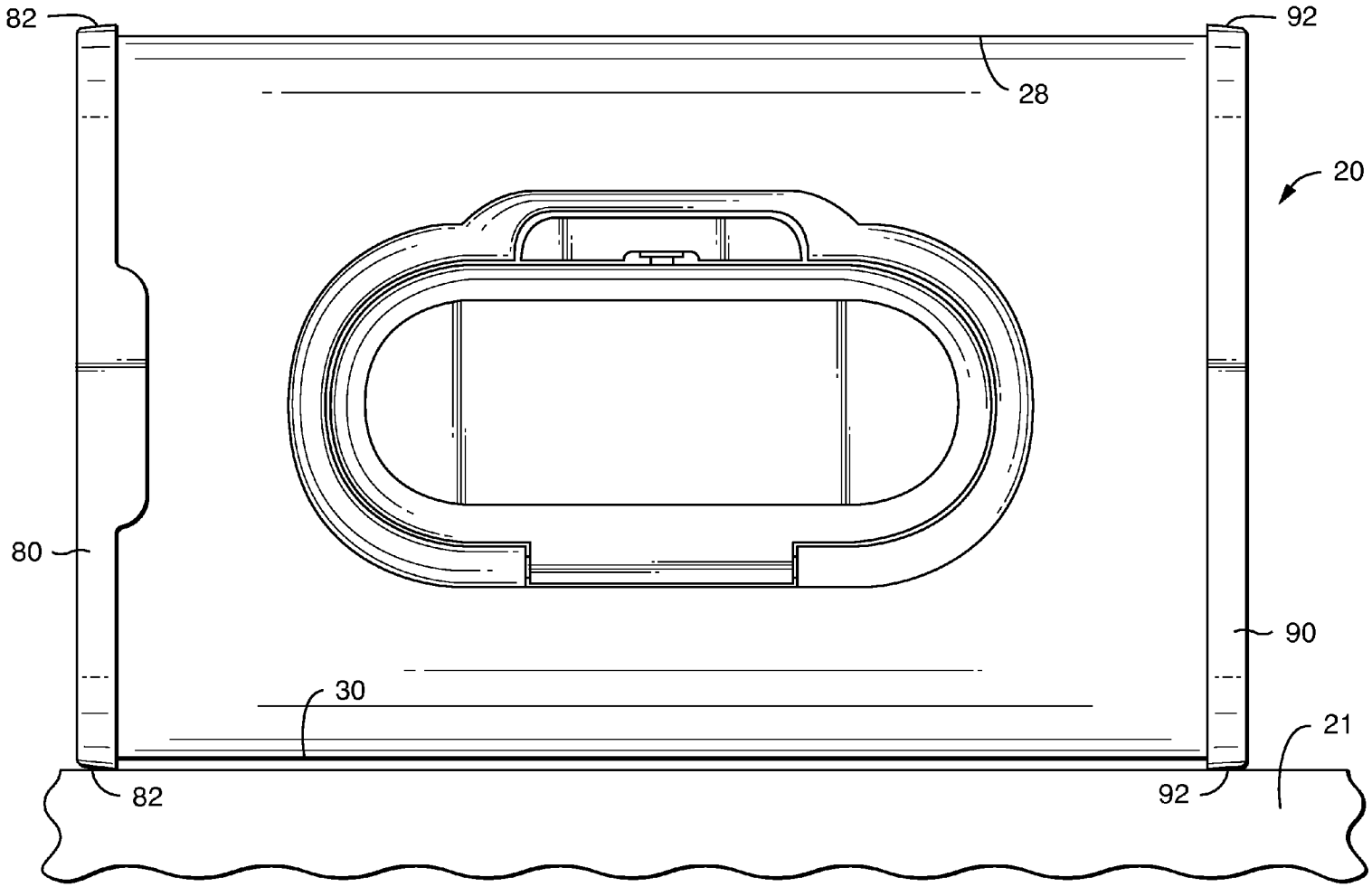
FIG. 15B depicts the embodiment of FIGS. 1-3 positioned on a surface in a second orientation.
Figure 15C:
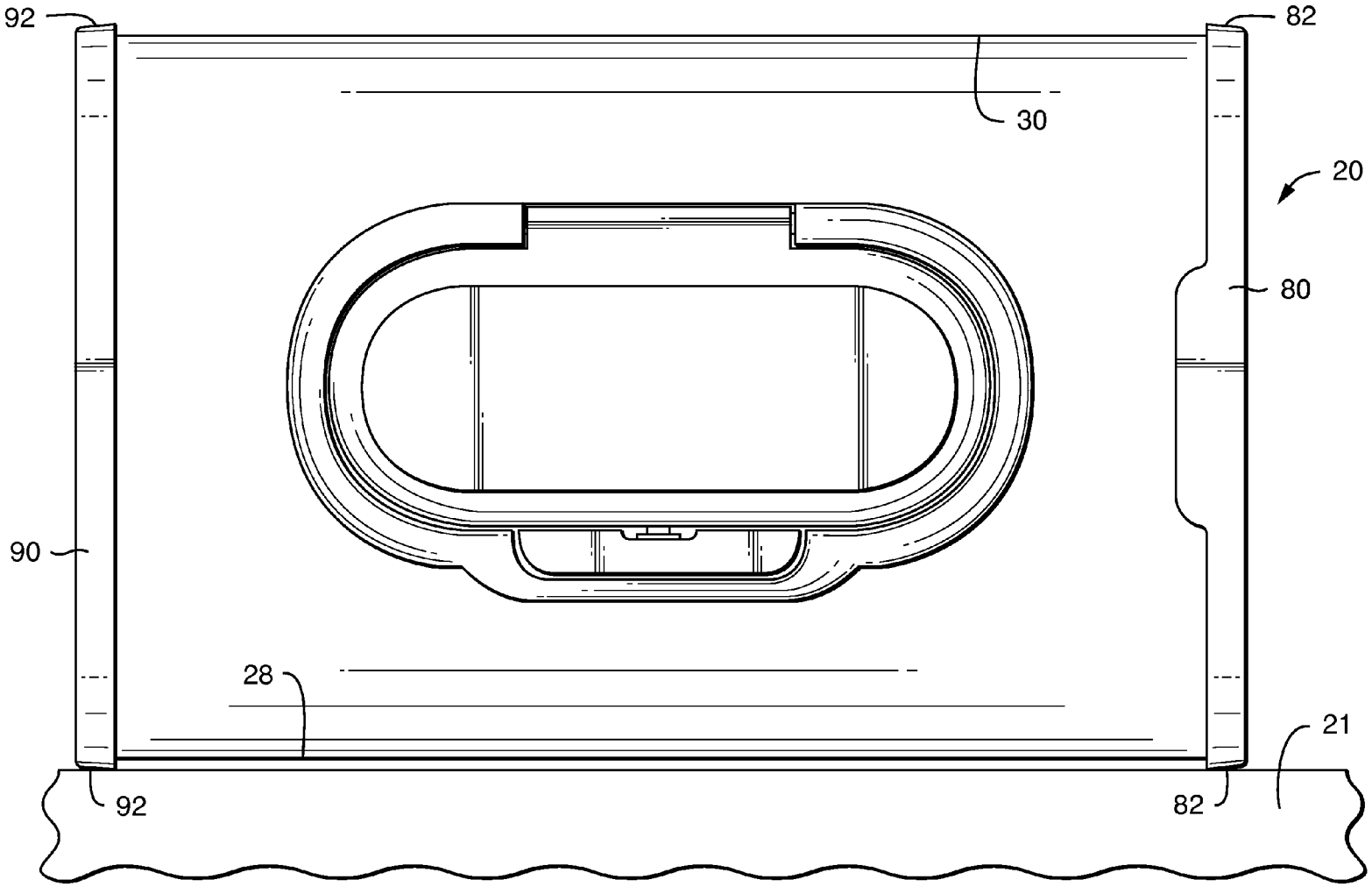
FIG. 15C depicts the embodiment of FIGS. 1-3 positioned on a surface in a third orientation.
Figure 15D:
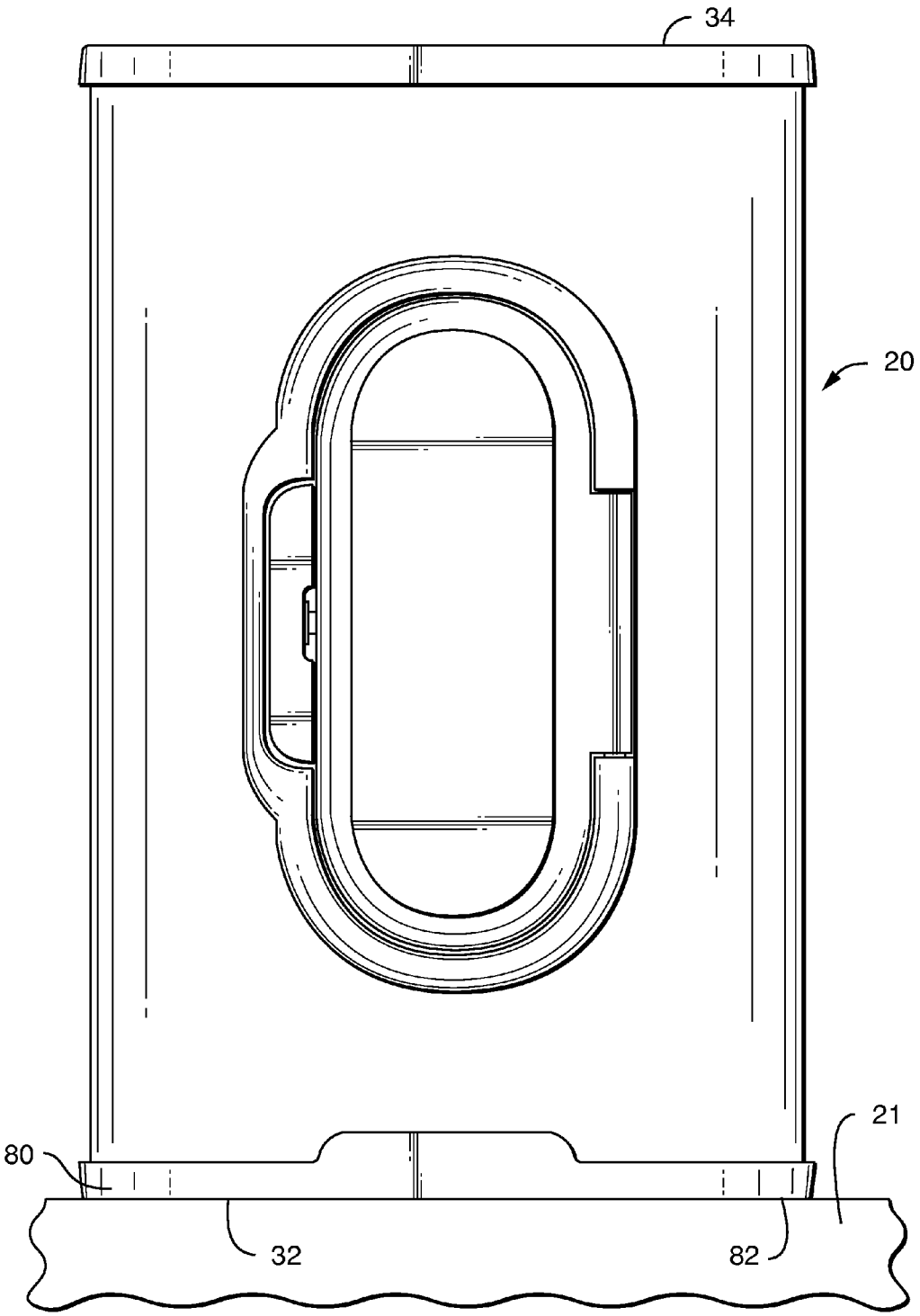
FIG. 15D depicts the embodiment of FIGS. 1-3 positioned on a surface in a fourth orientation.
Figure 15E:
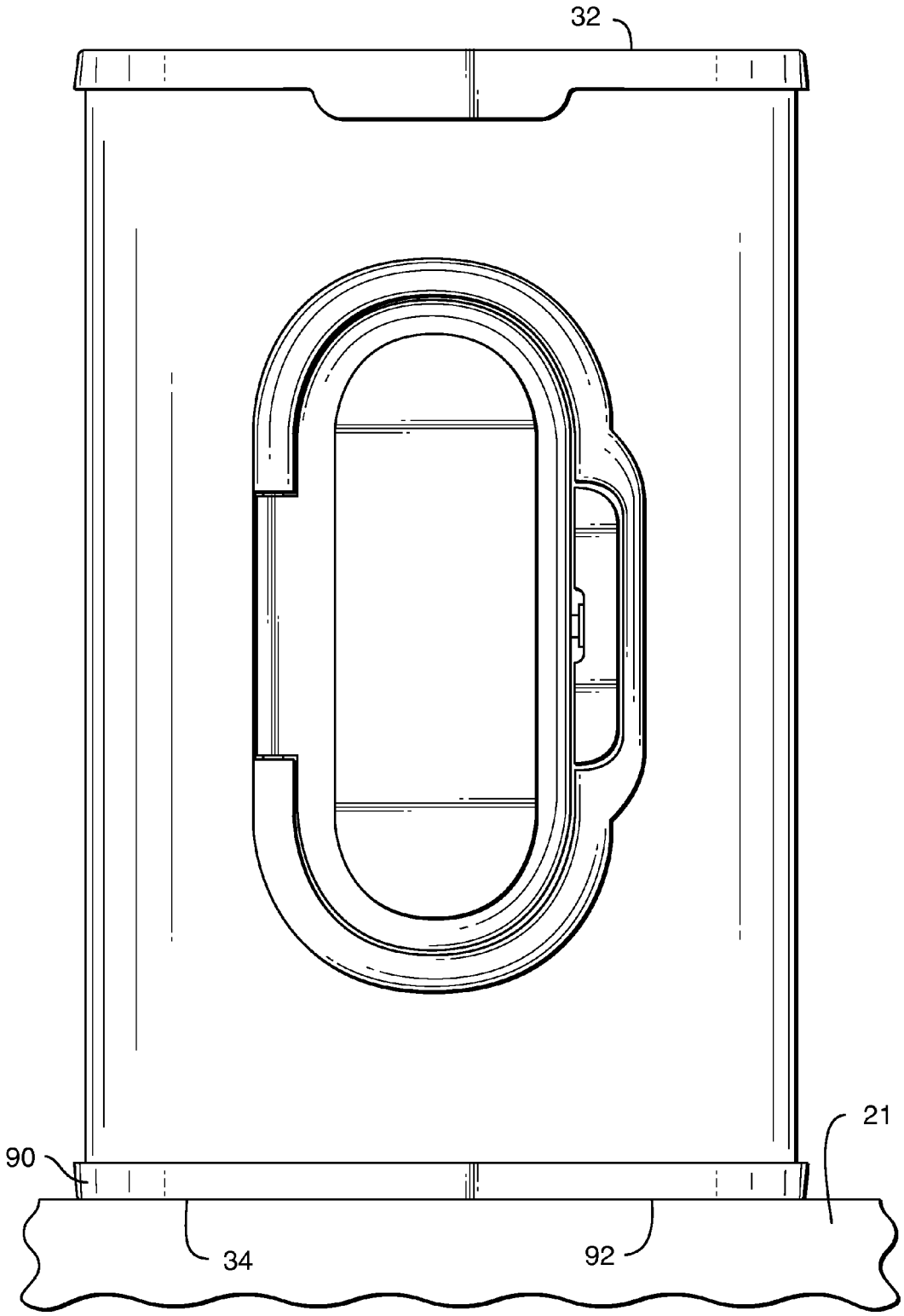
FIG. 15E depicts the embodiment of FIGS. 1-3 positioned on a surface in a fourth orientation.

As representatively illustrated in FIG. 15A, thermoplastic elastomer material 82 in the first slip-resistant periphery 80 and thermoplastic elastomer material 92 in the second slip-resistant periphery 90 each contact the flat surface 21 when the bottom wall 26 faces the flat surface 21. Also, as representatively illustrated in FIG. 15B, thermoplastic elastomer material 82 in the first slip-resistant periphery 80 and thermoplastic elastomer material 92 in the second slip-resistant periphery 90 each contact the flat surface 21 when the second side wall 30 faces the flat surface 21. Similarly, as representatively illustrated in FIG. 15C, thermoplastic elastomer material 82 in the first slip-resistant periphery 80 and thermoplastic elastomer material 92 in the second slip-resistant periphery 90 each contact the flat surface 21 when the first side wall 28 faces the flat surface 21. Still further, as representatively illustrated in FIG. 15D, thermoplastic elastomer material 82 in the first slip-resistant periphery 80 contacts the flat surface 21 when the first end wall 32 faces the flat surface 21. Finally, as representatively illustrated in FIG. 15E, thermoplastic elastomer material 92 in the second slip-resistant periphery 90 contacts the flat surface 21 when the second end wall 34 faces the flat surface 21.

By including first and second slip-resistant perimeters 80, 90 in this manner, it is possible in particular embodiments of the present invention to provide a wipes container 20 that resists slipping or sliding on flat surfaces (such as tables, desks, counters, dressers, store shelves, closet shelves, floors, auto dashboards, and the like), regardless of the orientation of the container. In other words, by disposing thermoplastic material throughout the peripheries of the first and second end walls as described, a handler of the container (such as a store shelve stocker, a shopper, or an end user) can set the container on its bottom wall, on either side wall, or on either end wall, and the container will resist slipping or sliding in each of these orientations. Such slip-resistance versatility is desirable because different retail stores or different end users may choose to orient the dispenser in different ways on the shelf, table, or other surface. Also, when an end user is extracting a wipe from the dispenser, it is desirable that the wipes dispenser resist slipping and sliding on the underlying table, counter, or other surface during the extraction. Also, in embodiments in which one or both of the end walls comprise a removable cap, the slip-resistant perimeter can enhance the gripability of the cap(s).

As representatively illustrated in FIGS. 13 and 14, in particular embodiments the thermoplastic elastomer material 82 in the first slip-resistant periphery 80 forms a continuous, unbroken loop 84 around the first slip-resistant periphery, and the thermoplastic elastomer material 92 in the second slip-resistant periphery 90 forms a continuous, unbroken loop 94 around the second slip-resistant periphery 90. Such an approach can provide for ease of processing, a streamlined appearance, and ease of handling the end wall 32/34. In other embodiments, the thermoplastic elastomer material 82 in the first slip-resistant periphery 80 forms a discontinuous, intermittent pattern around the first slip-resistant periphery 80, and the thermoplastic elastomer material 92 in the second slip-resistant periphery 90 forms a discontinuous, intermittent pattern around the second slip-resistant periphery 90 (not shown).

Figure 1B:
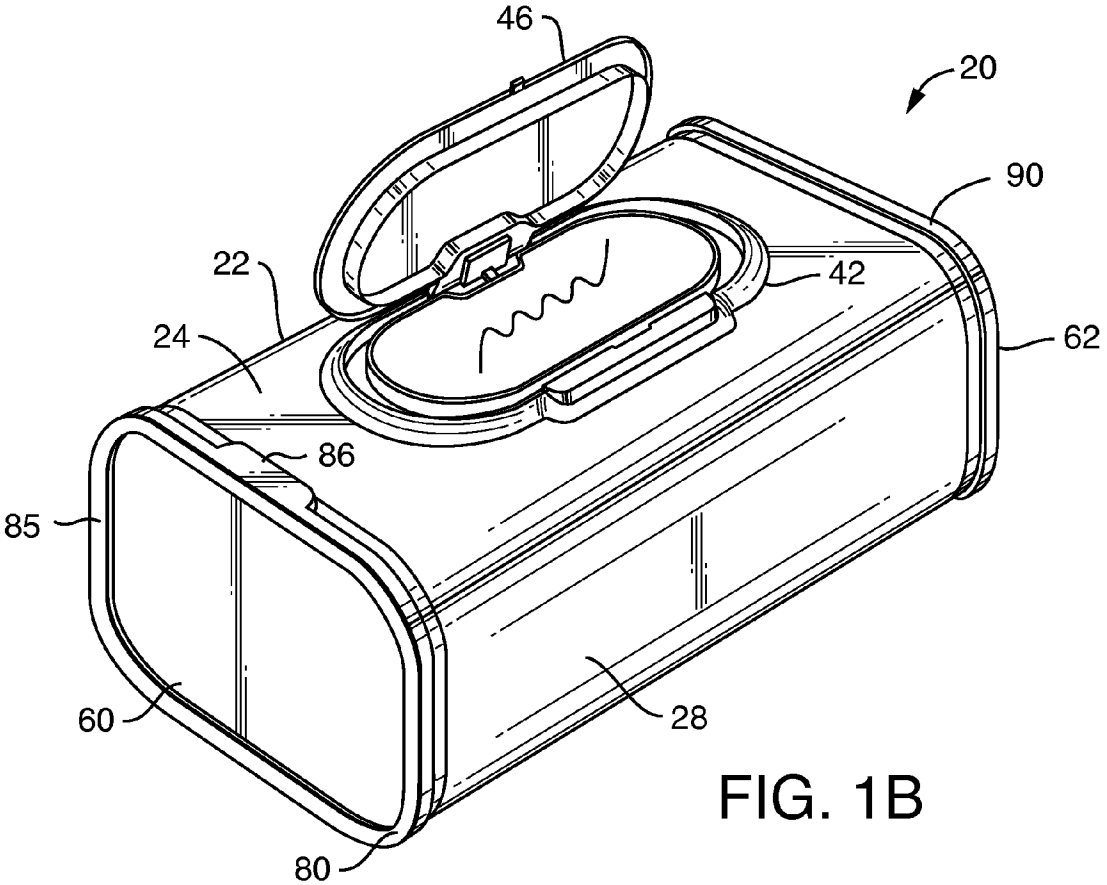
FIG. 1B representatively illustrates the embodiment of FIG. 1A, but with the flip top in the open position.
Figure 1C:
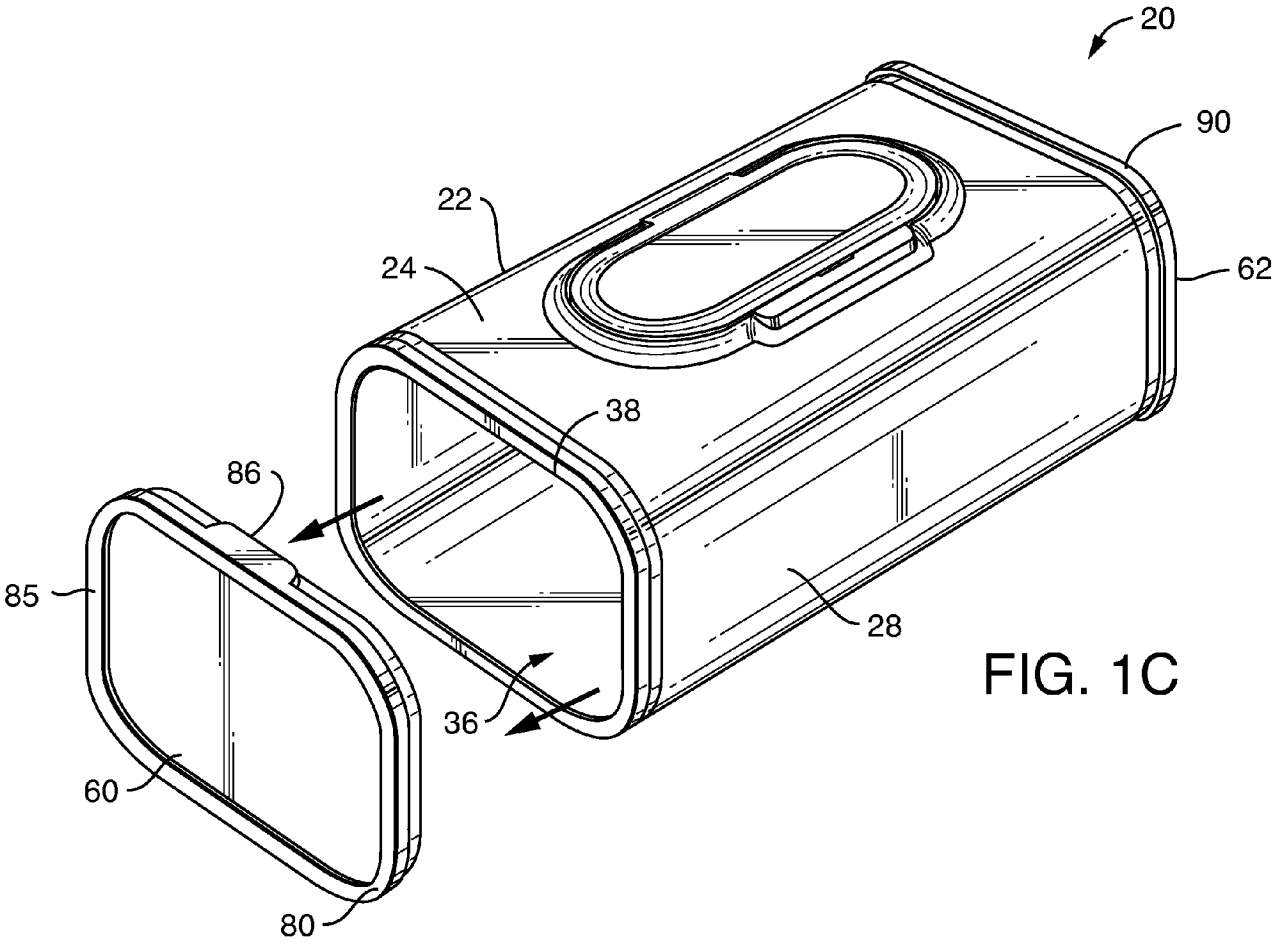
FIG. 1C representatively illustrates the embodiment of FIG. 1A, but with one end wall removable cap unattached.

Referring to FIGS. 1 and 13, in particular embodiments the first slip-resistant periphery 80 includes a first grip tab 86 that comprises thermoplastic elastomer material 82. The first grip tab 86 extends from the first end wall 32 toward the second end wall 34 over a portion of the top wall 24. In particular embodiments, the first slip-resistant periphery 80 can alternatively or also include a second grip tab 88 that comprises thermoplastic elastomer material 82. The second grip tab 88 extends from the first end wall 32 toward the second end wall 34 over a portion of the bottom wall 26. By including such a grip tab or tabs, a user can in particular embodiments more easily grasp and remove the first end wall 32 to provide access to the interior space 36. Furthermore, in embodiments in which a first end wall removable cap 60 and a second end wall removable cap 62 are included and would otherwise have a substantially identical appearance, the presence of one or more grip tabs on the first end wall removable cap allows a user to distinguish between the end walls, so that the user will know which end wall removable cap to remove to access the interior space to replenish the wipes.

Referring to FIGS. 13 and 14, in particular embodiments the thermoplastic elastomer material 82 of the first slip-resistant periphery 80 is integrally molded with a non-elastomer thermoplastic portion 83 of the first end wall 32. Similarly, the thermoplastic elastomer material 92 of the second slip-resistant periphery 90 is integrally molded with a non-elastomer thermoplastic portion 93 of the second end wall 34. Examples of materials suitable for the non-elastomer thermoplastic portion include polypropylene, polyethylene, acrylonitrile-butadiene-styrene (ABD), and other materials known in the art as suitable for injection molding or blow molding. In other embodiments, the thermoplastic elastomer materials 82/92 are not integrally molded with the non-elastomer thermoplastic portions 83/93 upon which they are disposed. Desirably, the thermoplastic elastomer materials 82/92 have a higher coefficient of friction than the non-elastomer thermoplastic portions 83/93 upon which they are disposed, based on coefficient of friction test ASTM D1894-11e1.

Figure 2:
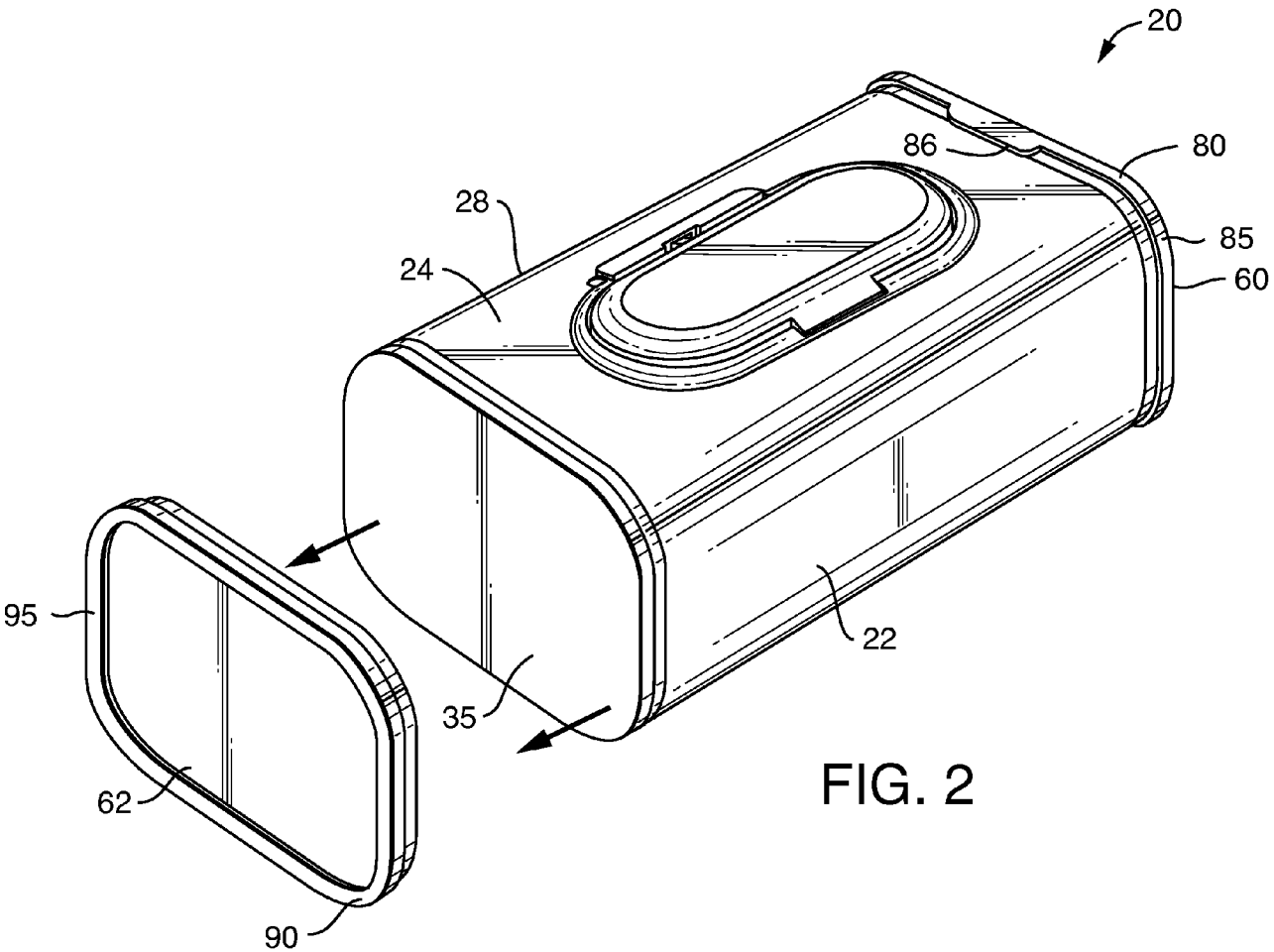
FIG. 2 representatively illustrates a rear right perspective view of the embodiment of FIG. 1A, but with one end wall removable cap unattached.
Figure 4:
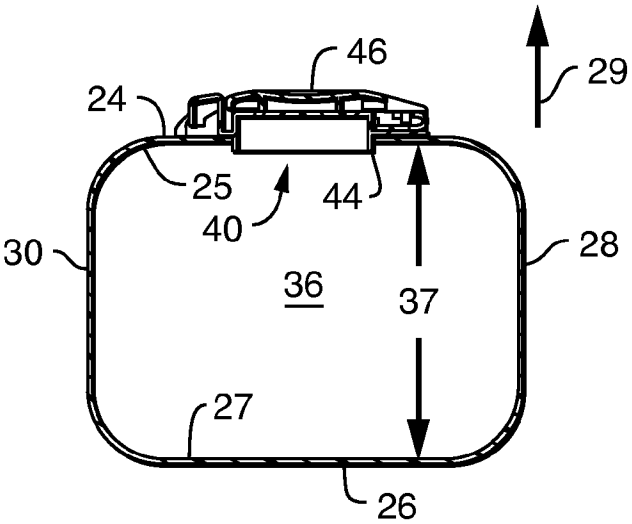
FIG. 4 representatively depicts a cross-sectional view of the embodiment of FIG. 3 taken at line 4-4.
Figure 3:
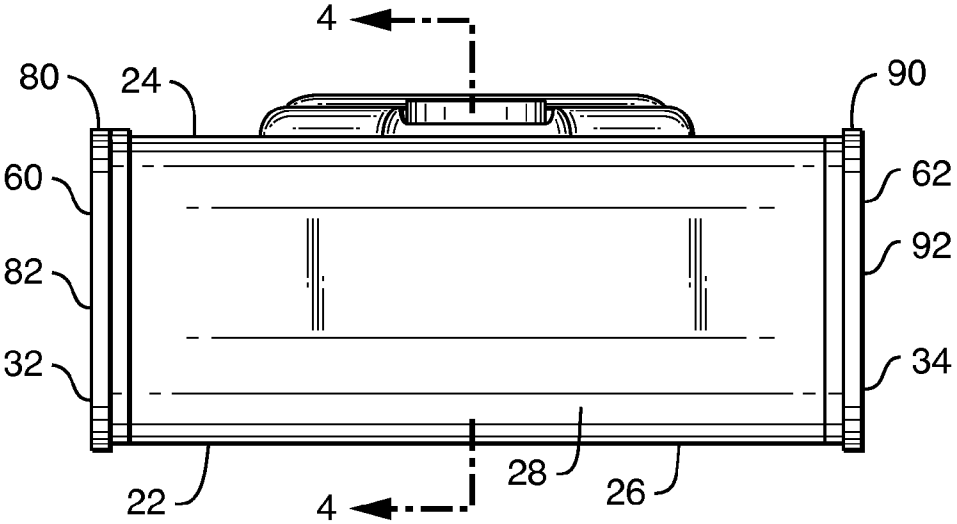
FIG. 3 representatively illustrates a front view of the embodiment of FIG. 1A.
Figure 6:
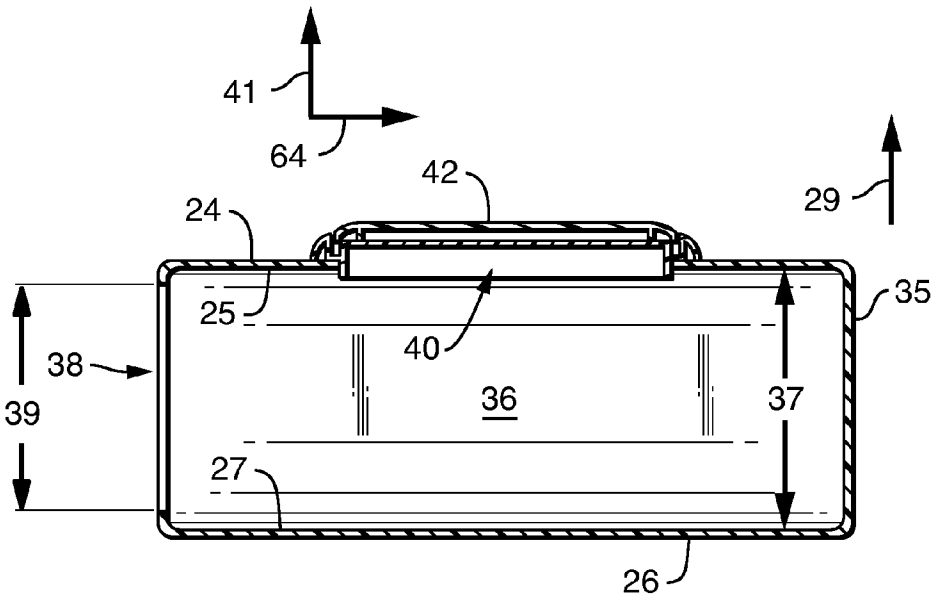
FIG. 6 representatively depicts a cross-sectional view of the embodiment of FIG. 5 taken at line 6-6.

Referring to FIGS. 1, 2, 13, and 14, in particular embodiments the container 20 has a first end 31 proximate the first end wall 32, and a second end 33 proximate the second end wall 34. The container includes a first thermoplastic elastomer loop 85 that wraps around the first end 31 of the container 20 along the top wall 24, bottom wall 26, first side wall 28, and second side wall 30. The container further includes a second thermoplastic elastomer loop 95 that wraps around the second end 33 of the container 20 along the top wall 24, bottom wall 26, first side wall 28, and second side wall 30. In particular embodiments, the first thermoplastic elastomer loop 85 is a continuous, unbroken loop (FIGS. 1 and 13), and/or the second thermoplastic elastomer loop 95 is a continuous, unbroken loop (FIGS. 2 and 14). In other embodiments, the first thermoplastic elastomer loop is a discontinuous, intermittent pattern of thermoplastic elastomer material, and/or the second thermoplastic elastomer loop is a discontinuous, intermittent pattern of thermoplastic elastomer material (not shown).

It will be appreciated that details of the foregoing embodiments, given for purposes of illustration, are not to be construed as limiting the scope of this invention. Although only a few exemplary embodiments of this invention have been described in detail, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

I claim:

1. A wipes container adapted to be set on a flat surface, the container comprising:

a dispenser housing defining a top wall spaced apart from and generally parallel to a bottom wall, a first side wall spaced apart from and generally parallel to a second side wall, and a first end wall spaced apart from and generally parallel to a second end wall, wherein all of the walls collectively define an interior space, wherein the top wall includes a dispensing orifice through which wipes can be extracted from the interior space; and a plurality of wipes disposed within the interior space, each wipe adapted to be extracted from the interior space through the dispensing orifice, the first end wall having a first slip-resistant periphery and the second end wall having a second slip-resistant periphery, each slip-resistant periphery comprising thermoplastic elastomer material, wherein said thermoplastic elastomer material is disposed along each periphery such that:

(1) thermoplastic elastomer material in the first slip-resistant periphery and thermoplastic elastomer material in the second slip-resistant periphery each contact said flat surface when the bottom wall faces said flat surface;

(2) thermoplastic elastomer material in the first slip-resistant periphery and thermoplastic elastomer material in the second slip-resistant periphery each contact said flat surface when either of the first and second side walls faces said flat surface;

(3) thermoplastic elastomer material in the first slip-resistant periphery contacts said flat surface when the first end wall faces said flat surface; and (4) thermoplastic elastomer material in the second slip-resistant periphery contacts said flat surface when the second end wall faces said flat surface.

2. The container of claim 1 wherein the thermoplastic elastomer material in the first slip-resistant periphery forms a continuous, unbroken loop around the first slip-resistant periphery, and wherein the thermoplastic elastomer material in the second slip-resistant periphery forms a continuous, unbroken loop around the second slip-resistant periphery.

3. The container of claim 1 wherein the thermoplastic elastomer material in the first slip-resistant periphery forms a discontinuous, intermittent pattern around the first slip-resistant periphery, and wherein the thermoplastic elastomer material in the second slip-resistant periphery forms a discontinuous, intermittent pattern around the second slip-resistant periphery.

4. The container of claim 1 wherein the first slip-resistant periphery includes at least one grip tab that comprises thermoplastic elastomer material and that extends from the first end wall toward the second end wall.

5. The container of claim 1 wherein the first slip-resistant periphery includes a first grip tab that comprises thermoplastic elastomer material and that extends from the first end wall toward the second end wall over a portion of the top wall, and wherein the first slip-resistant periphery includes a second grip tab that comprises thermoplastic elastomer material and that extends from the first end wall toward the second end wall over a portion of the bottom wall.

6. The container of claim 1 wherein the thermoplastic elastomer material of the first slip-resistant periphery is integrally molded with a non-elastomer thermoplastic portion of the first end wall, and wherein the thermoplastic elastomer material of the second slip-resistant periphery is integrally molded with a non-elastomer thermoplastic portion of the second end wall.

7. The container of claim 1 wherein the first end wall comprises a first removable cap having no permanent connection to the top wall, bottom wall, first side wall, or second side wall, and wherein the first end wall can be removed to provide access to the interior space via a refill orifice.

8. The container of claim 7 wherein the second end wall comprises a second removable cap having no permanent connection to the top wall, bottom wall, first side wall, or second side wall, wherein the second end wall can be removed from a remainder of the housing.

9. The container of claim 1 wherein the wipes are moist wipes.

10. A wipes container adapted to be set on a flat surface, the container comprising:

a dispenser housing defining a top wall spaced apart from and generally parallel to a bottom wall, a first side wall spaced apart from and generally parallel to a second side wall, and a first end wall spaced apart from and generally parallel to a second end wall, the top and bottom walls being generally perpendicular to the side walls and the end wall, and the side walls being generally perpendicular to the end walls, wherein all of the walls collectively define an interior space, the container having a first end proximate the first end wall and a second end proximate the second end wall;

wherein the top wall includes a dispensing orifice through which wipes can be extracted from the interior space;

a plurality of wipes disposed within the interior space, each wipe adapted to be extracted from the interior space through the dispensing orifice;

a first thermoplastic elastomer loop that wraps around the first end of the container along the top wall, bottom wall, first side wall, and second side wall; and a second thermoplastic elastomer loop that wraps around the second end of the container along the top wall, bottom wall, first side wall, and second side wall; wherein the first thermoplastic elastomer loop comprises a discontinuous, intermittent pattern of thermoplastic elastomer material, and wherein the second thermoplastic elastomer loop comprises a discontinuous, intermittent pattern of thermoplastic elastomer material.

11. The container of claim 10 wherein the first thermoplastic elastomer loop includes at least one grip tab that comprises thermoplastic elastomer material and that extends from the first end wall toward the second end wall.

12. The container of claim 10 wherein the first thermoplastic elastomer loop includes a first grip tab that comprises thermoplastic elastomer material and that extends from the first end wall toward the second wall over a portion of the top end wall, and wherein the first thermoplastic elastomer loop includes a second grip tab that comprises thermoplastic elastomer material and that extends from the first end wall toward the second end wall over a portion of the bottom wall.

13. The container of claim 10 wherein the first end wall comprises a first removable cap having no permanent connection to the top wall, bottom wall, first side wall, or second side wall, and wherein the first end wall can be removed to provide access to the interior space via a refill orifice.

14. The container of claim 13 wherein the second end wall comprises a second removable cap having no permanent connection to the top wall, bottom wall, first side wall, or second side wall, wherein the second end wall can be removed from a remainder of the housing.

15. The container of claim 10 wherein the wipes are moist wipes.

16. A moist wipes container adapted to be set on a flat surface, the container comprising:

a dispenser housing defining a top wall spaced apart from and generally parallel to a bottom wall, a first side wall spaced apart from and generally parallel to a second side wall, and a first end wall spaced apart from and generally parallel to a second end wall, wherein all of the walls collectively define an interior space, wherein the top wall includes a dispensing orifice through which wipes can be extracted from the interior space; and a plurality of wipes disposed within the interior space, each wipe adapted to be extracted from the interior space through the dispensing orifice, the first end wall having a first slip-resistant periphery and the second end wall having a second slip-resistant periphery, each slip-resistant periphery comprising thermoplastic elastomer material, wherein said thermoplastic elastomer material is disposed along each periphery such that:

(1) thermoplastic elastomer material in the first slip-resistant periphery and thermoplastic elastomer material in the second slip-resistant periphery each contact said flat surface when the bottom wall faces said flat surface;

(2) thermoplastic elastomer material in the first slip-resistant periphery and thermoplastic elastomer material in the second slip-resistant periphery each contact said flat surface when either of the first and second side walls faces said flat surface;

(3) thermoplastic elastomer material in the first slip-resistant periphery contacts said flat surface when the first end wall faces said flat surface; and (4) thermoplastic elastomer material in the second slip-resistant periphery contacts said flat surface when the second end wall faces said flat surface, wherein the thermoplastic elastomer material in the first slip-resistant periphery forms a continuous, unbroken loop around the first slip-resistant periphery, and wherein the thermoplastic elastomer material in the second slip-resistant periphery forms a continuous, unbroken loop around the second slip-resistant periphery, wherein the first slip-resistant periphery includes a first grip tab that comprises thermoplastic elastomer material and that extends from the first end wall toward the second end wall over a portion of the top wall, and wherein the first slip-resistant periphery includes a second grip tab that comprises thermoplastic elastomer material and that extends from the first end wall toward the second end wall over a portion of the bottom wall, wherein the thermoplastic elastomer material of the first slip-resistant periphery is integrally molded with a non-elastomer thermoplastic portion of the first end wall, and wherein the thermoplastic elastomer material of the second slip-resistant periphery is integrally molded with a non-elastomer thermoplastic portion of the second end wall, wherein the first end wall comprises a first removable cap having no permanent connection to the top wall, bottom wall, first side wall, or second side wall, and wherein the first end wall can be removed to provide access to the interior space via a refill orifice, and wherein the second end wall comprises a second removable cap having no permanent connection to the top wall, bottom wall, first side wall, or second side wall, wherein the second end wall can be removed from a remainder of the housing.

* * * * *